US012736059B2

(12) United States Patent
Shen et al.

(10) Patent No.: US 12,736,059 B2
(45) Date of Patent: Sep. 15, 2026

(54) AIR BLOWER

(71) Applicant: SUZHOU PINOTEC CO., LTD., Suzhou City (CN)

(72) Inventors: Guangping Shen, Suzhou City (CN); Guanglu Zhang, Suzhou City (CN); Yi Wang, Suzhou City (CN)

(73) Assignee: SUZHOU PINOTEC CO., LTD., Suzhou City (CN)

( * ) Notice: Subject to any disclaimer, the term of this patent is extended or adjusted under 35 U.S.C. 154(b) by 0 days.

(21) Appl. No.: 19/299,291

(22) Filed: Aug. 13, 2025

(65) Prior Publication Data

US 2026/0022703 A1 Jan. 22, 2026

Related U.S. Application Data

(63) Continuation of application No. PCT/CN2025/108886, filed on Jul. 16, 2025.

(30) Foreign Application Priority Data

Jul. 16, 2024 (CN) ..... 202410949124.8
Jul. 16, 2024 (CN) ..... 202421676299.8
Jul. 16, 2024 (CN) ..... 202421676576.5

(51) Int. Cl.

*F04D 25/06* (2006.01)
*F04D 19/00* (2006.01)
*F04D 25/08* (2006.01)
*F04D 27/00* (2006.01)

(52) U.S. Cl.

CPC ..... *F04D 25/0693* (2013.01); *F04D 19/002* (2013.01); *F04D 25/0673* (2013.01); *F04D 25/084* (2013.01); *F04D 27/00* (2013.01)

(58) Field of Classification Search

CPC ..... F04D 25/0673; F04D 25/084
See application file for complete search history.

(56) References Cited

U.S. PATENT DOCUMENTS 1,357,261 A * 11/1920 Svoboda ..... F04D 25/084 416/204 R
1,473,045 A * 11/1923 Puttaert ..... H02K 7/145 310/68 R
1,504,003 A * 8/1924 Trumbill ..... F04D 25/084 362/208
2,595,406 A * 5/1952 Popovich ..... F21L 2/00 417/313

(Continued)

FOREIGN PATENT DOCUMENTS

CN 111441970 A * 7/2020 ..... F04F 5/44
WO WO-2011052560 A1 * 5/2011 ..... F04D 25/0673

(Continued)

*Primary Examiner* — Christopher S Bobish
(74) *Attorney, Agent, or Firm* — Syncoda LLC; Feng Ma

(57) ABSTRACT

The present disclosure provides an air blower which comprises a housing provided with grip area; a motor disposed within the housing; an impeller disposed within the housing; a circuit board disposed within the housing; the circuit board is configured to be connected to the motor, and a conductive structure, one end of the conductive structure is configured to be connected to the circuit board, and another end of the conductive structure is configured to be exposed outward from the grip area.

8 Claims, 24 Drawing Sheets

(56) References Cited

U.S. PATENT DOCUMENTS 2,811,305 A * 10/1957 Scaroulis ..... F04D 25/084 416/143
2,909,316 A * 10/1959 Prohaczka ..... F21V 33/0088 416/246
3,697,198 A * 10/1972 Holder, Jr. ..... A47J 37/0754 126/25 B
3,997,115 A * 12/1976 Licudine ..... B05B 7/0075 239/351
4,734,017 A * 3/1988 Levin ..... H02K 7/145 D32/15
7,841,045 B2 * 11/2010 Shaanan ..... A47L 5/14 15/246
11,311,164 B2 * 4/2022 Machida ..... A47L 9/2857
11,759,830 B2 * 9/2023 Zhang ..... A47L 5/14 15/324
11,953,017 B1 * 4/2024 Chen ..... F04D 25/0673
12,023,748 B2 * 7/2024 Obermann ..... B23D 45/16
2019/0075639 A1 * 3/2019 Brueck ..... H02K 9/06
2022/0099096 A1 * 3/2022 Numata ..... F04D 25/0673
2022/0125267 A1 * 4/2022 Tagami ..... F04D 29/5806
2022/0408663 A1 * 12/2022 Cooper ..... H01M 50/298
2023/0249229 A1 * 8/2023 Zhang ..... F04D 25/084 15/324
2023/0265854 A1 * 8/2023 Chen ..... F04D 19/002 416/63
2024/0090643 A1 * 3/2024 Ahn ..... F04D 29/66

FOREIGN PATENT DOCUMENTS

WO WO-2016138961 A1 * 9/2016 ..... B25F 5/02
WO WO-2020166393 A1 * 8/2020 ..... F04D 29/5806
WO WO-2024131739 A2 * 6/2024 ..... F04D 25/0606

* cited by examiner

AIR BLOWER

CROSS-REFERENCE TO RELATED APPLICATIONS

This application is a continuation of International Patent Application No. PCT/CN2025/108886 filed on Jul. 16, 2025 which claims priority to Chinese Patent Application No. 202410949124.8 filed on Jul. 16, 2024, Chinese Patent Application No. 202421676576.5 filed on Jul. 16, 2024, and Chinese Patent Application No. 202421676299.8 filed on Jul. 16, 2024. The disclosures of the above-referenced applications are hereby incorporated by reference in their entirety.

BACKGROUND

Air blowers are commonly used in outdoor cleaning, including car washing, water blowing, leaf removal, and other scenarios. To enhance cleaning performance, the device rotates at high speed driven by its motor to generate powerful airflow. However, this operation leads to the following issues: (1) increased electrostatic accumulation inside the fan, resulting in electrostatic discharge (ESD) that may damage internal circuits; and (2) elevated heat generation that, when not effectively dissipated, may cause damage to internal circuitry.

SUMMARY

The present disclosure relates to a technical field of an air blower.

One or more embodiments of the present disclosure provide an air blower, comprising a housing provided with grip area, a motor disposed within the housing; an impeller disposed within the housing, a circuit board disposed within the housing; the circuit board is configured to be connected to the motor, and a conductive structure, one end of the conductive structure is configured to be connected to the circuit board, and another end of the conductive structure is configured to be exposed outward from the grip area.

One or more embodiments of the present disclosure provide an air blower comprising: a housing provided with an upper housing and a handle; a motor disposed within the housing; an impeller disposed within the housing; a circuit board disposed within the housing; the circuit board is configured to be connected to the motor; and an air guiding opening provided at the connection between the upper housing and the handle; the air guiding opening is configured to interconnect an inner cavity of the upper housing and the inner cavity of the handle; the air guiding opening is configured to guide part of the airflow from the upper housing into the inner cavity of the handle.

One or more embodiments of the present disclosure provide a display assembly, applied to an air blower, wherein the air blower having at least two operation levels; the at least two operation levels comprise a target operation level; a single operation duration of the air blower in the target operation level is less than or equal to a first preset value, comprising: a display module, configured to display a duration indicator area on the air blower, wherein the duration indicator area is used to indicate the remaining single operation duration of the air blower at the target level in real time.

BRIEF DESCRIPTION OF THE DRAWINGS

This description will be further explained in the form of exemplary embodiments, which will be described in detail by means of accompanying drawings. These embodiments are not restrictive, in which the same numbering indicates the same structure, wherein.

Figure 1:
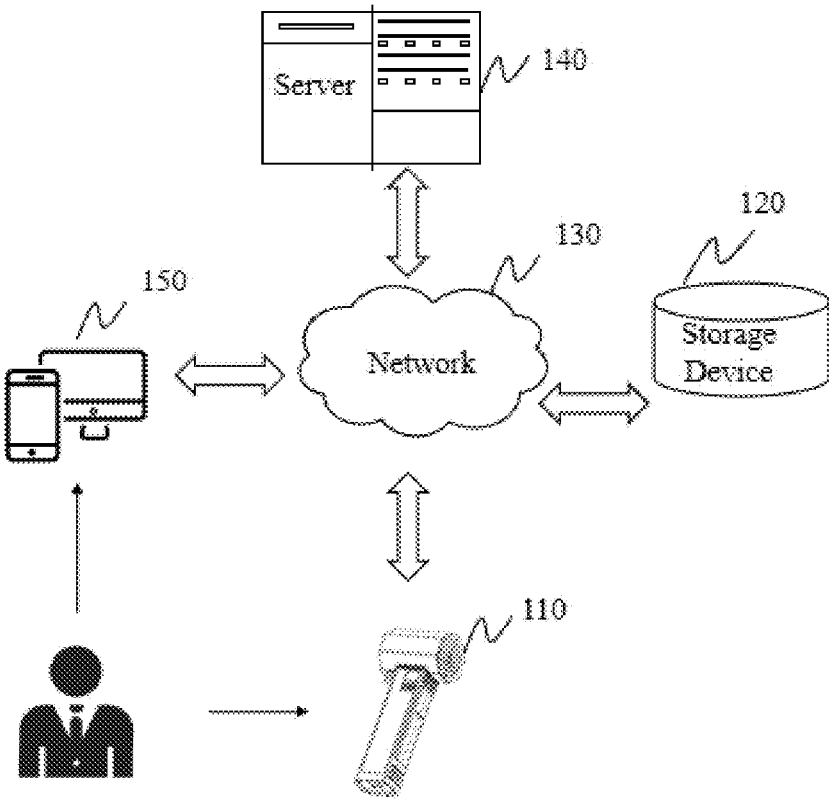
FIG. 1 is a schematic diagram illustrating an exemplary application scenario of an air blower system according to some embodiments.

Numerals in the drawings: 110—air blower; 120—storage device; 130—network; 140—server; 150—user terminal; 210—housing; 211—upper housing; 212—lower housing; 212-1—upper cover; 212-2—base housing; 220—charging port; 230—power switch; 240—conductive body; 250—air inlet end; 260—grip area; 310—lighting component; 320—air outlet end; 330—first button; 340—second button; 410—conductive structure; 411—conductive wire; 420—first circuit board; 421—negative electrode; 430—battery; 510—second circuit board; 520—third circuit board; 611—first opening; 612—second opening; 620—MOS transistors; T-air guiding opening; 810—first sub-cylinder; 820—slot; 910—electrostatic prevention plate; S-exit; 1010—glue layer; 1110—blower cylinder; 1120—second sub-cylinder; 1130—third sub-cylinder; 1210—motor; 1220—support structure; 1221—blade; 1310—impeller; 1410—arcuate slope surface; 1420—air outlet grid; 1510—air inlet grid; 2010—duration indicator area; 2011—starting position; 2012—ending position; 2013—indicator mark; 2040—display screen; 2100—display assembly; 2110—display module; 2120—controlling module; 2210—bayonet structures; 2220—third adjustment button; 2230—electrostatic prevention housing; 2240—vibration motor; 2250—speaker; 2260—conductive patch; 2310—extension nozzle; 2320—pressure-boosting air nozzle; 2410—bluetooth communication chip; 1910—light trip; 1911 light beads.

DETAILED DESCRIPTION

The technical schemes of embodiments of the present disclosure will be more clearly described below, and the accompanying drawings need to be configured in the description of the embodiments will be briefly described below. Obviously, the drawings in the following description are merely some examples or embodiments of the present disclosure, and will be applied to other similar scenarios according to these accompanying drawings without paying creative labor. Unless obviously obtained from the context or the context illustrates otherwise, the same numeral in the drawings refers to the same structure or operation.

It should be understood that the terms "system", "device", "unit" and/or "module" used herein are a way to distinguish between different components, elements, parts, sections or assemblies at different levels. However, the words may be replaced by other expressions if other words accomplish the same purpose.

As shown in the present disclosure and the claims, unless the context clearly suggests an exception, the words "one," "a", "an", and/or "the" do not refer specifically to the singular, but may also include the plural. Generally, the terms "including" and "comprising" suggest only the inclusion of clearly identified steps and elements and do not constitute an exclusive list, the method or apparatus may also include other steps or elements.

Flowcharts are used in the present disclosure to illustrate operations performed by a system in accordance with embodiments of the present disclosure. It should be appreciated that the preceding or following operations are not necessarily performed in an exact sequence. Instead, steps may be processed in reverse order or simultaneously. Also, it is possible to add other operations to these processes, or to remove a step or steps from these processes.

As depicted in FIG. 1, the system includes: an air blower device 110 communicatively coupled to a network 130; a storage device 120 operatively connected to the network 130; a server 140 in network communication via the network 130; and a user terminal 150 (containing at least one processor, not shown) configured for network connectivity, wherein the user terminal is capable of establishing communication with both the network 130 and the air blower device 110.

As depicted in FIGS. 2-15, the air blower 110 may include a housing 210, a motor 1210, an impeller(s) 1310, one or more circuit board(s), power supply component (e.g., battery), and etc.

Figure 2:
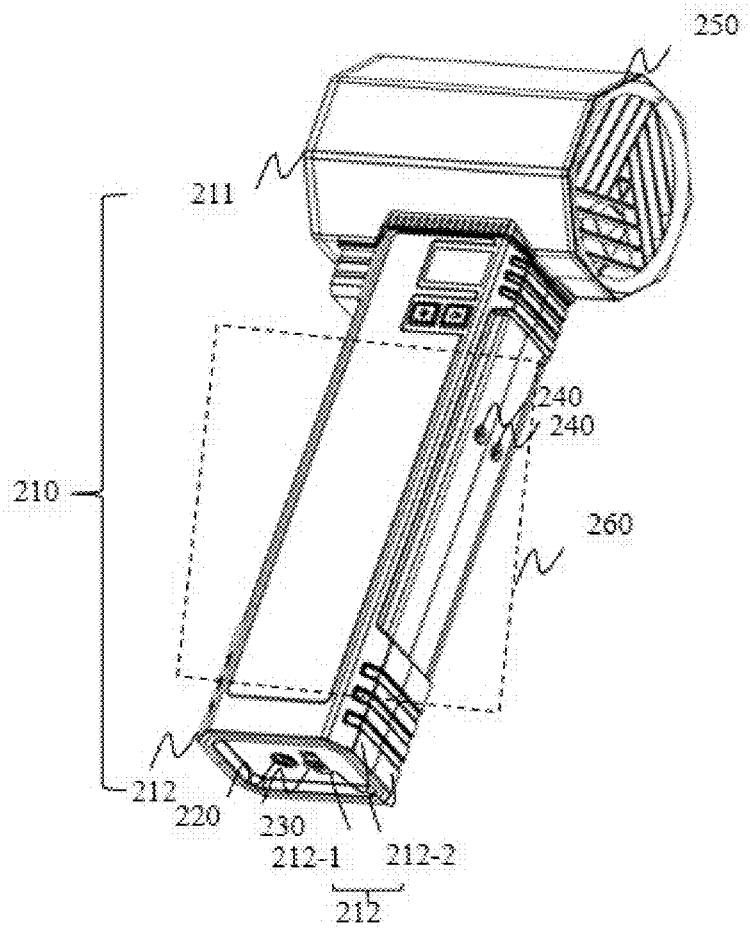
FIG. 2 is an exemplary structural diagram of an air blower according to some embodiments.

As shown in FIG. 2, the housing 210 is used to accommodate and fix the components of the air blower 110. In some embodiments, the housing 210 may include a lower housing 212 and an upper housing 211. In some embodiments, the lower housing 212 may be provided as a handle. In some embodiments, the handle may be provided with a grip area 260. For example, the user may grip the grip area 260 of the handle to perform a blowing operation. In some embodiments, the grip area 260 may be configured to conform to an ergonomic design to reduce user hand fatigue. In some embodiments, the grip area 260 may be covered with an anti-slip layer, such as a rubber coat or a frosted surface, to increase friction between the hand and the grip area 260, thereby preventing the air blower 110 from slipping during use.

Figure 3:
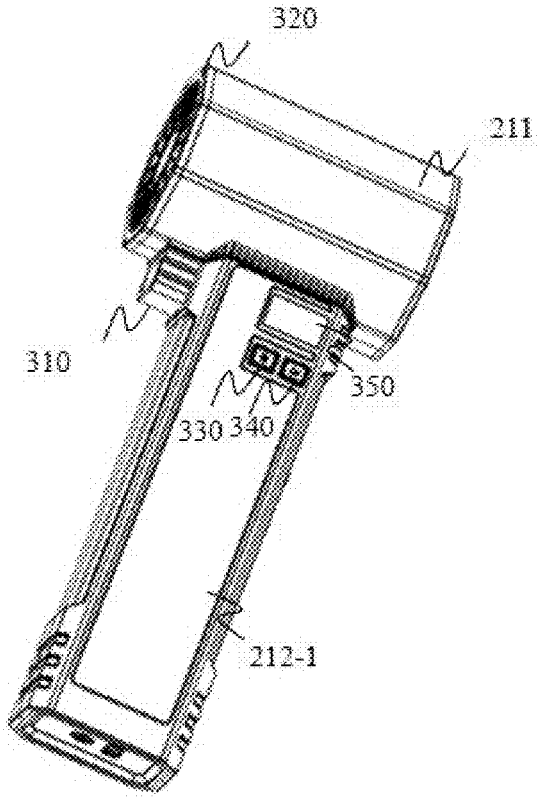
FIG. 3 is an exemplary structural diagram of adjustment button(s) according to other embodiments of the present disclosure.

In some embodiments, the air blower 110 may include an air inlet end 250 and an air outlet end 320 as shown in FIG. 2 and FIG. 3.

In some embodiments, the air blower 110 may also include a charging port(s) 220 which is configured to supply power to the air blower 110. The air blower 110 may be connected to a power adapter via the charging port(s) 220 to charge a battery(s) 430 or supply power directly to the air blower. In some embodiments, the charging port(s) 220 may include a lightning port, a type-c port, a micro-usb port, or the like. In some embodiments, the charging port(s) 220 may be disposed on the handle. For example, the charging port(s) 220 may be arranged on the bottom of the handle or other sides of the handle.

In some embodiments, the air blower 110 may also include a power switch 230 which is configured to turn on/off the power supply from the battery 430 to the air blower 110. When the power switch 230 is turned off, the battery 430 does not supply power to any component (e.g., a display assembly 2100, a lighting component 310, and/or a motor 1210) of the air blower 110. In some embodiments, the power switch 230 may be disposed on the handle. The power switch 230 may be disposed on the bottom of the handle or other positions of the handle.

In some embodiments, the charging port(s) 220 and the power switch 230 may each be positioned on the same side of the handle. In other embodiments, the charging port(s) 220 and the power switch 230 may be positioned on different sides of the handle.

In some embodiments, the handle may include an upper cover 212-1 and a base housing 212-2. In some embodiments, the upper cover 212-1 may snap together with the base housing 212-2. In some embodiments, the upper housing 211 and the base housing 212-2 may be integrally formed.

Figure 5:
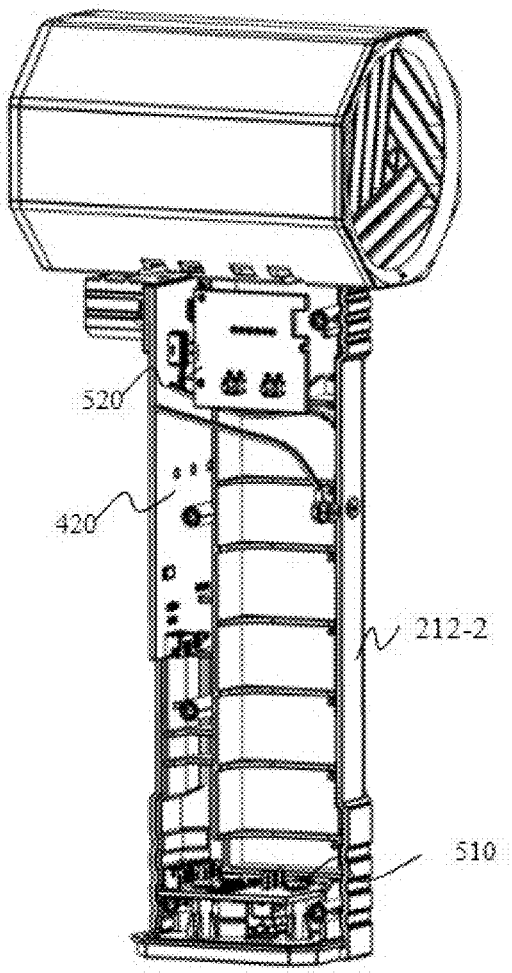
FIG. 5 is an exemplary structural diagram of internal structure of an air blower according to some embodiments of the present disclosure.

In some embodiments, the air blower 110 may further include a circuit board(s). In some embodiments, the circuit board(s) may be disposed within a handle. In some embodiments, as shown in FIG. 5, the circuit board(s) may include a first circuit board 420, a second circuit board 510, and a third circuit board 520.

In some embodiments, the first circuit board 420 may be disposed within one side of the handle, which is close to the battery 430. In some embodiments, the first circuit board 420 may be electrically respectively connected to the motor 1210 and the battery 430. In some embodiments, the first circuit board 420 may be provided with a control circuit and electronics (e.g., MOS transistor(s), etc.), which may be configured to adjust current, so as to adjust the rotation speed of the impeller 1310.

In some embodiments, the first circuit board 420 may be vertically disposed at an exit S of an air guiding opening T.

In some embodiments, the second circuit board 510 may be disposed at the bottom of the battery 430. In some embodiments, the second circuit board 510 may be respectively electrically connected to the charging port(s) 220, the power switch 230 and/or the battery 430. In some embodiments, the second circuit board 510 may be provided with a charge circuit(s), which may be configured to charge the battery 430.

In some embodiments, the air blower could also be configured to supply power to an external device (e.g., a user terminal) via a charging port(s).

In some embodiments, the third circuit board 520 may be disposed on the top of the battery 430. In some embodiments, the third circuit board 520 may be respectively electrically connected to the display assembly 2100, the first button 330, and/or the second button 340.

In some embodiments, the first circuit board 420 may be oriented towards the slot 820.

In some embodiments, the air blower 110 may include an adjustment button(s). In some embodiments, the adjustment button(s) may be configured to control a lighting component 310 and operation levels.

For example, as shown in FIG. 3, the adjustment button(s) may include at least a first button 330 and a second button 340. In some embodiments, the first button 330 and the second button 340 may be disposed on the handle, such as on an upper cover 212-1 or on a base housing 212-2. In some embodiments, the first button 330 and the second button 340 may be disposed close to the grip area 260. For example, both the first button 330 and the second button 340 may be disposed on the top or the bottom of the grip area 260. In some embodiments, the first button 330 and the second button 340 may be respectively disposed on different sides of the handle.

In some embodiments, the first button 330 may be configured to turn on/off the lighting component, and/or adjust the light intensity. For example, the user may press the first button 330 to switch the lighting component between an power-on state and an power-off state. In some embodiments, the first button 330 may be configured to control the light intensity. For example, the user may adjust the light intensity by rotating the first button 330 as the form of a knob or by pressing for a certain period of time.

Figure 16:
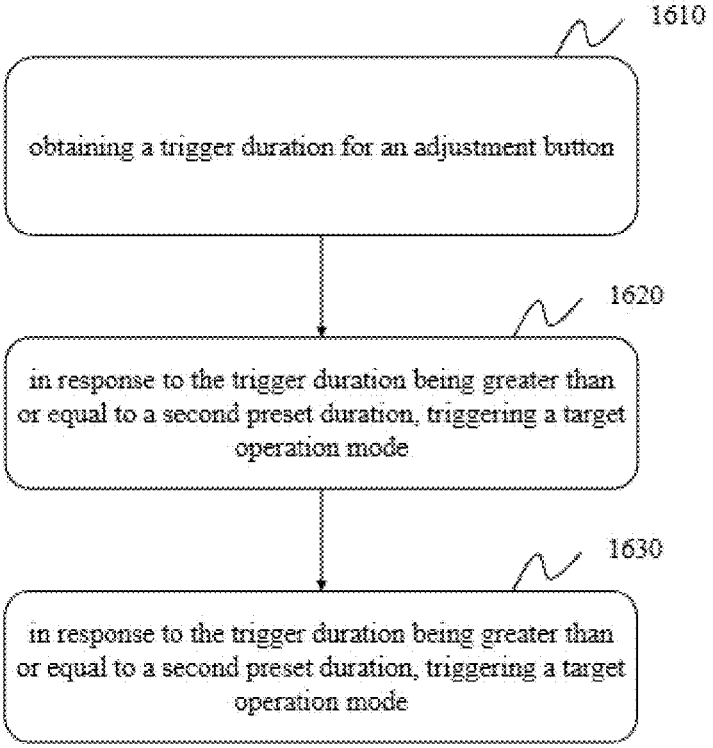
FIG. 16 is an exemplary flowchart of an indicating method according to some embodiments of the present application.

In some embodiments, the second button 340 may be configured turn on/off the airflow, and/or adjust the air volume of the airflow. In some embodiments, different operation levels may be switched by the set a pressing time duration for the second button 340. More descriptions of the second button 340 may refer to a FIG. 16 and its related descriptions.

Figure 4:
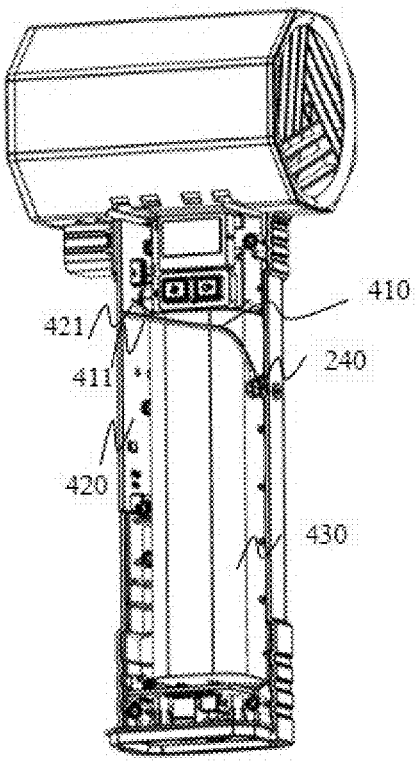
FIG. 4 is an exemplary structural diagram of an air blower with the upper cover opened according to some embodiments of the present disclosure.

In some embodiments, the air blower 110 may further include a battery(s). In some embodiments, the battery(s) may be disposed within the handle. In some embodiments, as shown in FIG. 4, a battery 430 may be disposed longitudinally along the length direction of a handle, perpendicular to an upper housing 211. In some embodiments, the battery 430 could be one battery or a group of batteries. The battery 430 may have a capacity range of 2000 mAh×8 to 2200 mAh×8. In some embodiments, the battery 430 may operate with a discharge current range of 0-60 A. In some embodiments, the adjustment button (e.g., the first button 330 or the second button 340) may control the battery 430 to discharge at percentages such as 20%, 40%, 70%, or 100% of its maximum power, thereby adjusting the rotational speed of the motor 1210.

Figure 6:
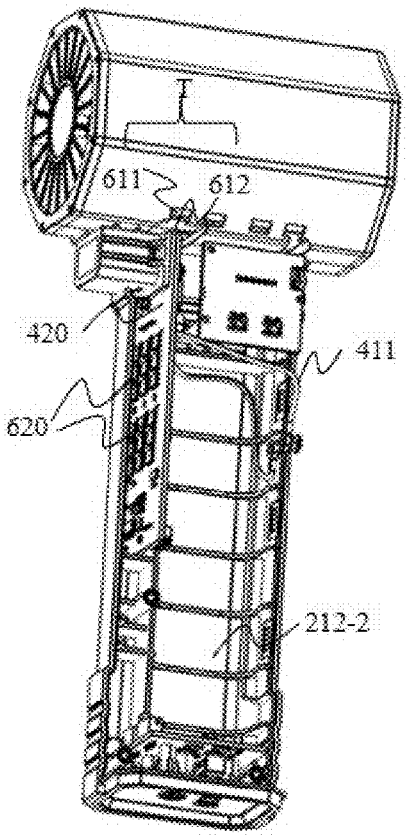
FIG. 6 is an exemplary structural diagram of internal structure of an air blower according to some other embodiments of the present disclosure.
Figure 7:
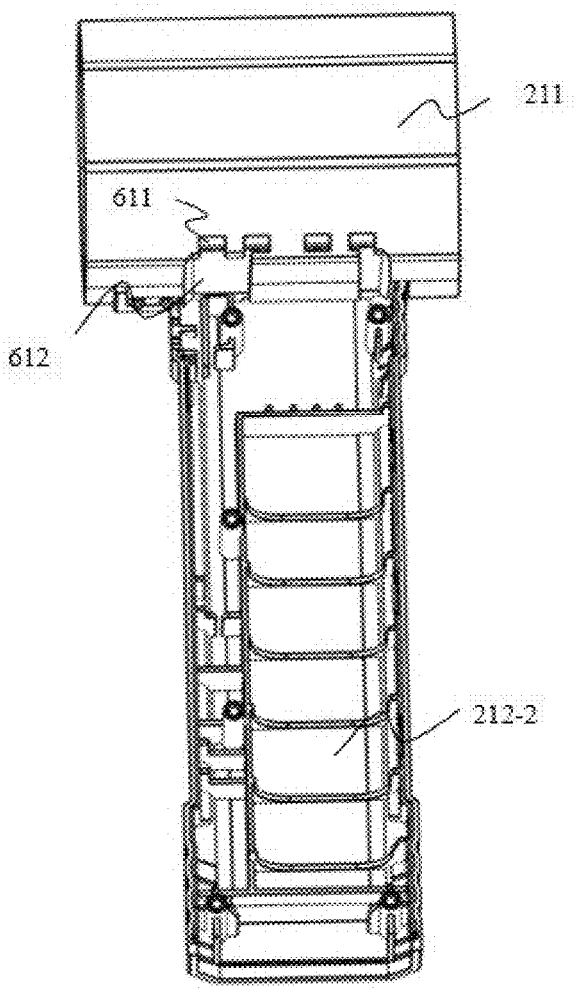
FIG. 7 is an exemplary structural diagram of an air guiding opening according to some embodiments of the present disclosure.

In some embodiments, as shown in FIG. 6 and FIG. 7, an air blower 110 may include an air guiding opening T which may include an opening(s) such as a first opening 611 and/or a second opening 612. In some embodiments, the air guiding opening T may be disposed at the connection between an upper housing and a handle.

Figure 11:
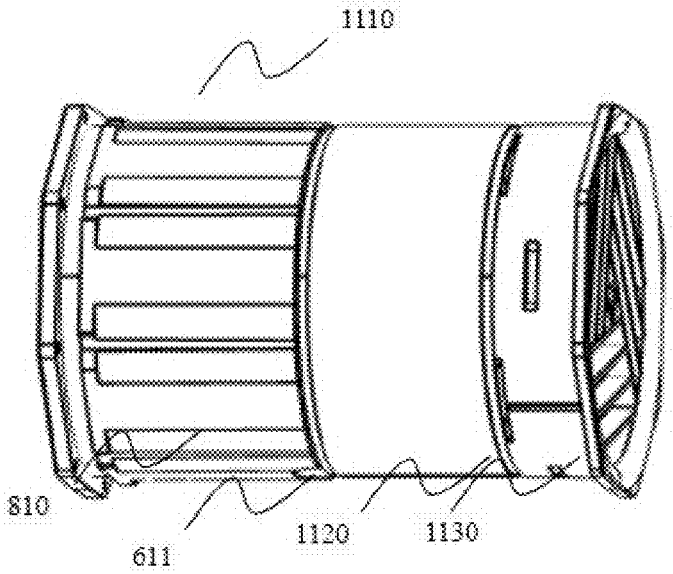
FIG. 11 is an exemplary structural diagram of a blower cylinder according to some embodiments of the present disclosure.

In some embodiments, as shown in FIG. 6 and FIG. 11, the first opening 611 may be disposed beneath a first sub-cylinder 810, and the first opening 611 faces towards the base housing 212-2. In some embodiments, as shown in FIG. 6 and FIG. 7, the second opening 612 may be disposed beneath the upper housing 211, and the second opening 612 faces towards the base housing 212-2. In some embodiments, the first opening 611 and the second opening 612 may be interconnected to form the air guiding opening T.

In some embodiments, the air guiding opening T may be configured to interconnect an inner cavity of the upper housing 211 and the inner cavity of the handle. In some embodiments, when the air blower 110 is working, the air guiding opening T could dissipate heat for a circuit board (e.g., a first circuit board 420) by guiding part of the airflow generated by the rotation of impeller 1310 in the upper housing 211 into the inner cavity of the handle, or it could also dissipate heat for the battery 430.

In some embodiments, the air guiding opening T may also function as a wiring hole through which the power line of the motor 1210 can be introduced from the upper housing 211 into the inner cavity of the handle 11, and connected to the first circuit board 420 and the battery 430.

As shown in FIG. 11, the air blower 110 include a blower cylinder 1110. The blower cylinder 1110 may be embedded within an upper housing 211. In some embodiments, the blower cylinder 1110 may include a first sub-cylinder 810, a second sub-cylinder 1120, and a third sub-cylinder 1130, which may be sequentially arranged from the air outlet end 320 toward the air inlet end 250.

The air inlet end 250 and the air outlet end 320 are respectively disposed on the two opposite sides of a housing 210 as shown in FIG. 2 and FIG. 3 in order to enable a more direct and smooth airflow channel, minimizing air resistance and improving output efficiency.

The air inlet end 250 could also be disposed on the bottom of the handle, and the air outlet end 320 may be disposed on the upper housing 211, so as to leverage natural convection (e.g., low-inlet/high-outlet), preventing hot air recirculation.

The air inlet end 250 may be configured to introduce air drawn from outside by an impeller 1310. The air outlet end 320 may be configured to exhaust airflow. In some embodiments, the air outlet end 320 may be disposed on the first sub-cylinder 810, and the air inlet end 250 may be disposed on the third sub-cylinder 1130.

Figure 14:
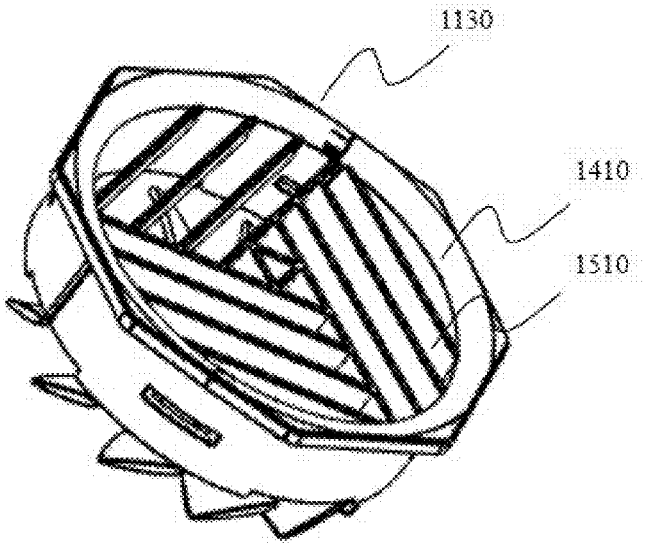
FIG. 14 is an exemplary structural diagram of an arcuate slope surface according to some embodiments of the present disclosure.
Figure 15:
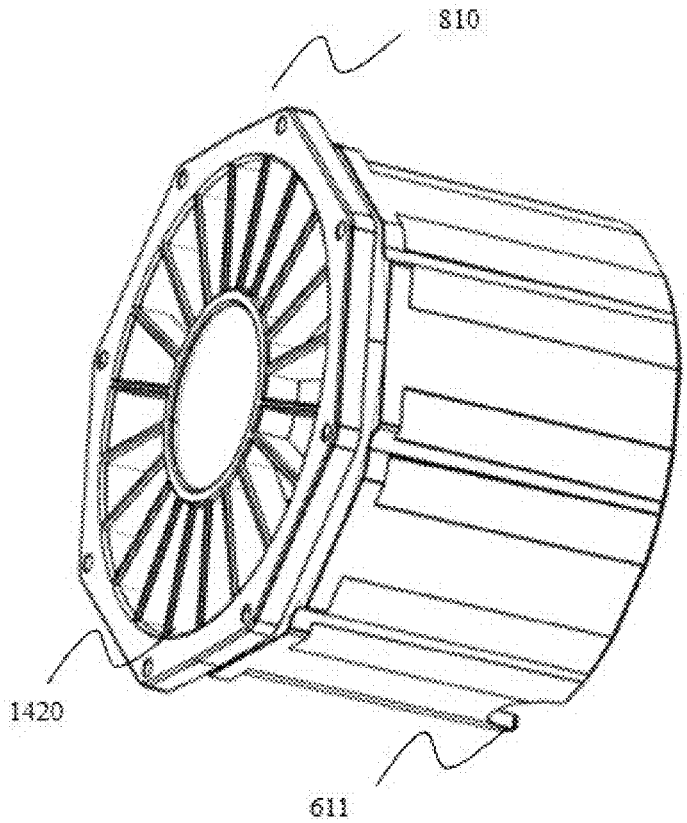
FIG. 15 is an exemplary structural diagram of an air outlet grid according to some embodiments of the present disclosure.

In some embodiments, the air blower 110 may include an air inlet grid 1510 as shown in FIG. 14 and an air outlet grid 1420 as shown in FIG. 15.

In some embodiments, the inner diameter of the blower cylinder 1110 outside the air inlet grid 1510 decreases from the outside to the inside. As shown in FIG. 14, an air blower 110 may include the arcuate slope surface 1410, which is disposed on the outer side of an air inlet grid 1510. In some embodiments, the arcuate slope surface 1410 may cause the inner diameter of a blower cylinder 1110 outside the air inlet grid 1510 to gradually decrease from the outer end toward the inner end, thereby increasing the airflow of the air blower 110.

As shown in FIG. 15, the air outlet grid 1420 may be disposed on an air outlet end 320.

Figure 12:
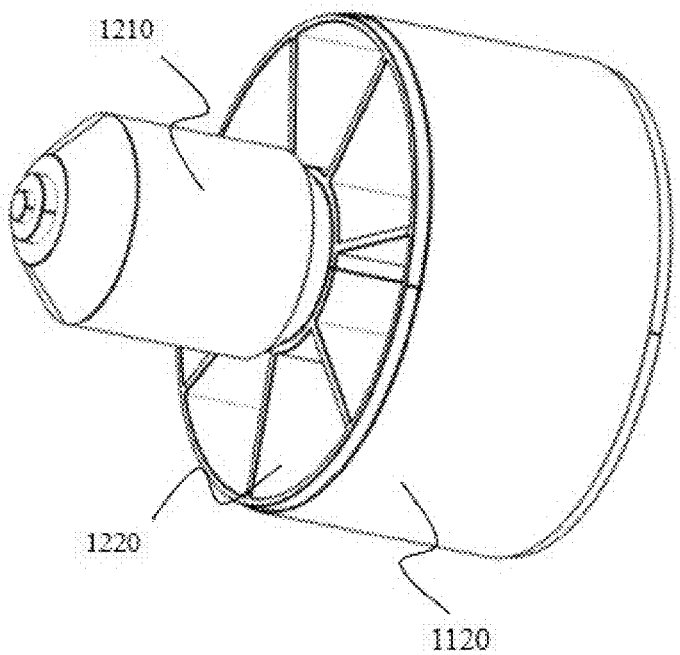
FIG. 12 is an exemplary structural diagram of a support structure according to some embodiments of the present disclosure.
Figure 13:
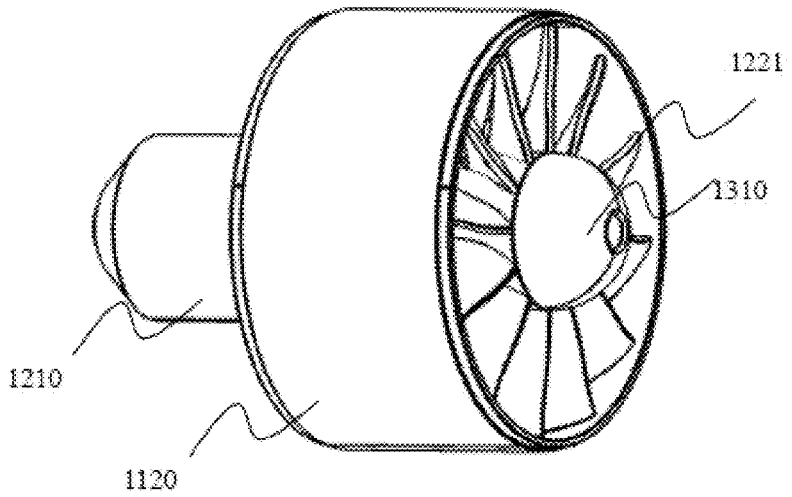
FIG. 13 is an exemplary structural diagram of a mounting structure of the motor and the impeller within a blower cylinder according to some embodiments of the present disclosure.

In some embodiments, as shown in FIG. 12, an air blower 110 may further include a support structure 1220, which may be configured to support a motor 1210 and/or an impeller 1310. The motor 1210 may be configured to drive the rotation of the impeller 1310. In some embodiments, the motor 1210 is a brushless motor 1210. In some embodiments, a rotational speed of the brushless motor 1210 may be 1000 rpm to 55500 rpm.

In some embodiments, the motor 1210 may be disposed within an upper housing 211. As an embodiment shown in FIG. 13, the motor 1210 and the impeller 1310 may be coaxially disposed within the upper housing 211. In this case, the airflow is introduced from the side of the upper housing 211 and discharged from another side of the upper housing 211.

In some embodiments, the motor 1210 may be disposed within the handle, and the impeller 1310 may be disposed within the upper housing 211. In this case, the airflow is introduced from the bottom of the handle and discharged from the upper housing 211. In this case, since the motor is disposed farther from the air outlet end, the direction of noise transmission is away from the user's ear, reducing auditory discomfort and improving user experience.

In some embodiments, the impeller 1310 may be configured to draw in external air to generate airflow. For example, the impeller 1310 may draw in surrounding air through its rotation, and channel it into the air inlet end 250 of the air blower 110. In some embodiments, a rotation speed of the impeller 1310 may be adjustable. For example, a user may adjust the rotation speed of the impeller 1310 by rotating an adjustment button of the air blower 110. As another example, the user may adjust the rotation speed of the impeller 1310 by pressing the adjustment button of the air blower 110. More descriptions of the adjustment button may refer to a FIG. 3 and its related descriptions.

In some embodiments, the impeller 1310 may be a centrifugal impeller 1310, an axial flow impeller 1310, a mixed flow impeller 1310, or the like. In some embodiments, the impeller 1310 may include a plurality of blades 1221.

In some embodiments, the impeller 1310 and the motor 1210 may be arranged coaxially, and supported by a support structure 1220 within a second sub-cylinder 1120, so as to be disposed inside the blower cylinder 1110.

In some embodiments, the impeller 1310 and the motor 1210 may not be arranged coaxially. For example, the impeller 1310 and the motor 1210 may be respectively arranged within the upper housing 211 and the handle, and be connected via a gear or a belt. In some embodiments, by using non-coaxial transmission, the motor can be disposed in the slender handle while the impeller resides in the wider upper housing, helping reduce overall thickness or size and improving portability and aesthetics.

Figure 8:
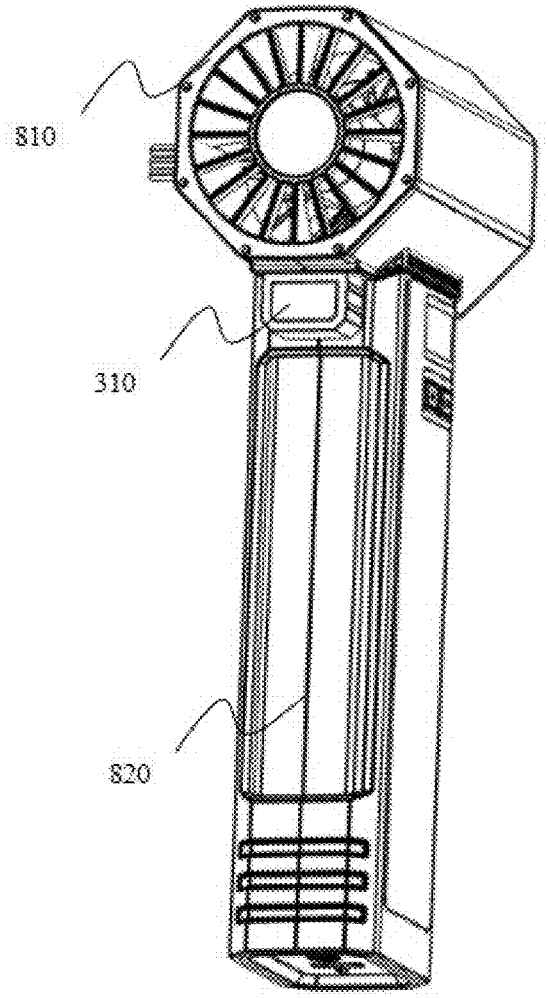
FIG. 8 is an exemplary structural diagram of front structure of an air blower according to some embodiments of the present disclosure.

In some embodiments, as shown in FIG. 8, the air blower 110 may include a lighting component(s) 310. In some embodiments, the lighting component 310 may be disposed on the same side of the housing 210 as the air outlet end 320. The lighting component 310 can face an air blowing object together with the air outlet end 320 in order to illuminate an air blowing object and/or a target area, especially in the dark environment.

The lighting component(s) 310 may be disposed in the contact area between the handle and a lower edge of the upper housing 211 as shown in FIG. 8. In some embodiments, the lighting component(s) 310 may be disposed on the bottom and/or other sides of the handle. When there are multiple lighting components on different positions of the air blower, the illumination effect would be enhanced, the illumination area would be enlarged and the shadow interference by gripping would also be prevented.

In some embodiments, the lighting component(s) may include an LED bead(s) which could be electronically connected to a first circuit board. The LED beads(s) could be disposed on the first circuit board 420 and covered by translucent cover(s) which is engaged between the base housing 210 and the upper cover 212-1.

Figure 21:
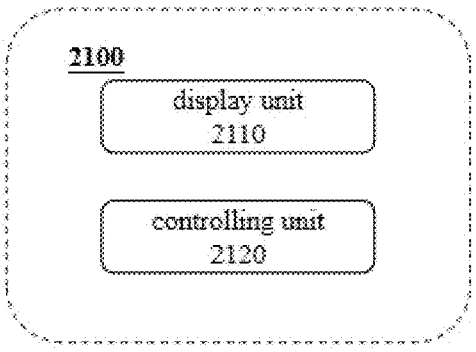
FIG. 21 is an exemplary module diagram of a displaying device according to some embodiments of the present disclosure.

In some embodiments, as shown in FIG. 21, the air blower 110 may further include a display assembly 2100. The display assembly 2100 may be configured to display information related to the air blower 110. For example, the display assembly 2100 may display information such as remaining battery level, an airflow speed, an airflow temperature, operation levels, and/or the continuous single operation duration, etc. More descriptions of the continuous single operation duration may refer to a FIG. 17 and its related descriptions.

Figure 20:
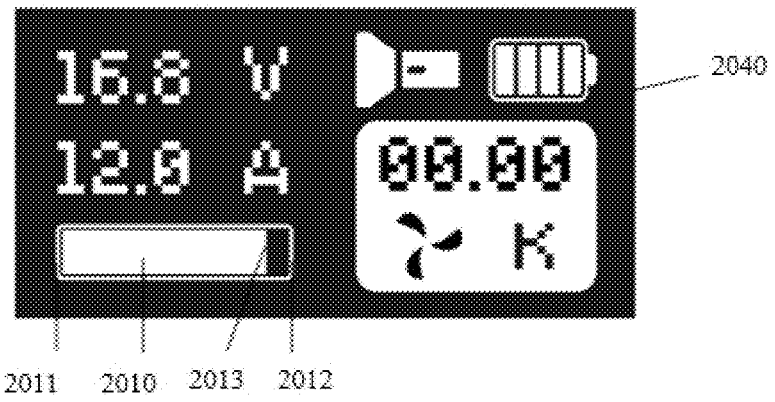
FIG. 20 is an exemplary schematic diagram illustrating a duration indicator area according to some embodiments of the present disclosure.

In some embodiments, as shown in FIG. 20, the display assembly 2100 may include a display screen 2040, such as a light-emitting diode (LED) display screen 2040 or a liquid crystal display (LCD) screen. In some embodiments, the display assembly 2100 may include a plurality of light-emitting elements. In some embodiments, the brightness of the display screen 2040 could be adjustable.

In some embodiments, the display assembly 2100 may be configured to display the operating voltage of the battery 430, the operating current of the battery 430, the rotational speed of the motor 1210, and/or the operation level information.

In some embodiments, the display assembly 2100 may perform the indicating method of the present disclosure. More descriptions of the indicating method may refer to FIG. 16 and its related descriptions. More descriptions of the display assembly 2100 may refer to the relevant descriptions provided later in this disclosure.

In some embodiments, the air blower 110 may further include a temperature detection component. The temperature detection component may be configured to detect a device temperature, an environment temperature, and/or an airflow temperature. The device temperature refers to the temperature of the circuit board(s) of the air blower. The environment temperature refers to a temperature of surrounding environment of the air blower 110. The airflow temperature refers to a temperature of airflow generated by the air blower 110.

In some embodiments, the temperature detection component may include a temperature sensor(s). Different temperature sensors could be used to detect the device temperature, environment temperature, and the airflow temperature.

In some embodiments, at least one of the temperature value among the device temperature, the environment temperature and the airflow temperature is displayed on the display assembly 2100. In some embodiments, a first temperature sensor used for detecting the device temperature is disposed in the inner cavity of the housing 210. The first temperature sensor could be disposed within the inner cavity on a side proximate to the circuit board(s) and/or the battery 430, thereby improving the accuracy of the device temperature. In some embodiments, a second temperature sensor used for detecting the environment temperature could be disposed on a housing 210 surface. The second temperature sensor could be disposed on the housing 210 surface, which is away from the circuit board and/or the battery 430, thereby improving the accuracy of the environment temperature. In some embodiments, a third temperature sensor used to detect the airflow temperature could be disposed on the air outlet end 320 of the air blower 110, thereby improving the accuracy of the airflow temperature.

In some embodiments, the temperature detection component may transmit the device temperature, the environment temperature, and/or the airflow temperature to the user terminal 150 and/or the server 140 for inquiry by the user at any time directly or indirectly, e.g., through the network 130.

In some embodiments, the air blower 110 may further include a heating unit, which may be configured to heat the airflow drawn in from the air inlet end 250. In some embodiments, the heating unit may be provided with a resistance coil(s) or a ceramic heating element(s). For example, the resistance coil(s) or the ceramic heating element(s) may heat itself by the current flowing through them, thereby heating the airflow.

In some embodiments, the heating unit may be disposed at a location within the housing 210 where the airflow may circulate. For example, the heating unit may be disposed around an air outlet end 320 or the air inlet end 250. As another example, the heating unit may be disposed within a blower cylinder 1110.

In some embodiments, the air blower may include electrostatic prevention component, such as an electrostatic prevention plate(s), or an electrostatic prevention housing.

Figure 9:
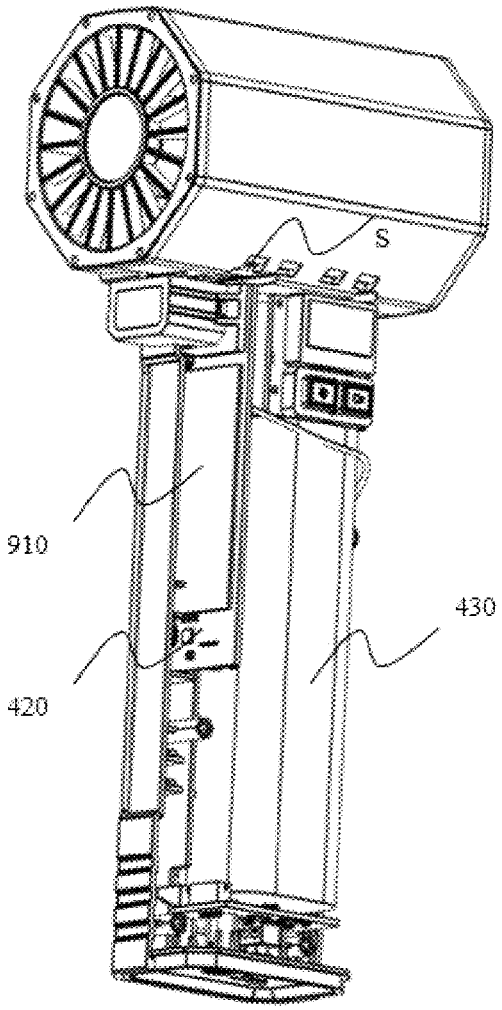
FIG. 9 is an exemplary structural diagram of internal structure of an air blower according to some other embodiments of the present disclosure.

In some embodiments, as shown in FIG. 9, the air blower 110 may be provided with the electrostatic prevention plate(s) 910. The electrostatic prevention plate(s) 910 may be configured to prevent the static electricity flowing into the circuit board, especially the static electricity caused by user, which may lead to circuit board damage.

In some embodiments, each of the electrostatic prevention plate(s) 910 may be disposed between the circuit board (e.g., the first circuit board 420, the second circuit board 510, or the third circuit board 520) and a slot 820, which is formed between the base housing 212-2 and the upper cover 212-1, thereby decreasing damage to the circuit boards caused by electrostatic discharge from a human body.

In some embodiments, the electrostatic prevention plate(s) 910 may be disposed at a slot 820 of the handle. For example, the electrostatic prevention plate(s) 910 may be disposed at the slot 820 provided at the interlocking junction of the base housing 212-2 and the upper cover 212-1.

In some embodiments, as shown in FIG. 6, to enhance an effect of electrostatic prevention, the electrostatic prevention plate 910 may be configured to cover at least the area on the circuit board where the MOS transistors 620 are located.

In some embodiments, the electrostatic prevention plate(s) 910 may be insulated. For the electrostatic prevention plate(s) 910 may be provided as an electrically insulating plate. In some embodiments, material for preparing the electrostatic prevention plate(s) 910 may include but not limited to epoxy resin, polyvinyl chloride, rubber, ceramic, glass fiber, and/or carbon fiber. For example, the electrostatic prevention plate 910 may be implemented as an epoxy resin plate.

Figure 10:
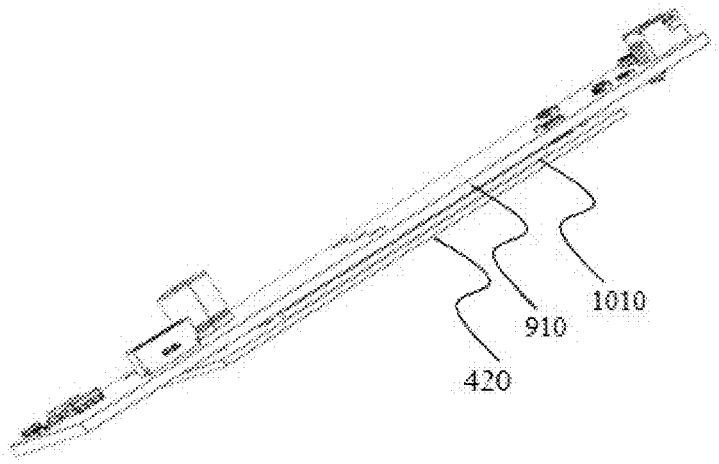
FIG. 10 is an exemplary structural diagram of connection relationship between an electrostatic prevention plate and a first circuit board according to some embodiments of the present disclosure.

In some embodiments, as shown in FIG. 10, the electrostatic prevention plate(s) 910 may be attached to the circuit board through a glue layer 1010. In some embodiments, the glue layer 1010 may be a thermally conductive silicone pad.

In some embodiments of the present disclosure, the electrostatic prevention plate 910 made of an insulating material is disposed at the slot 820 of the handle to effectively prevent static electricity from the human body from flowing the handle, thereby reducing the likelihood of damage to the circuit board caused by static discharge and extending the service life of the air blower 110.

Figure 22:
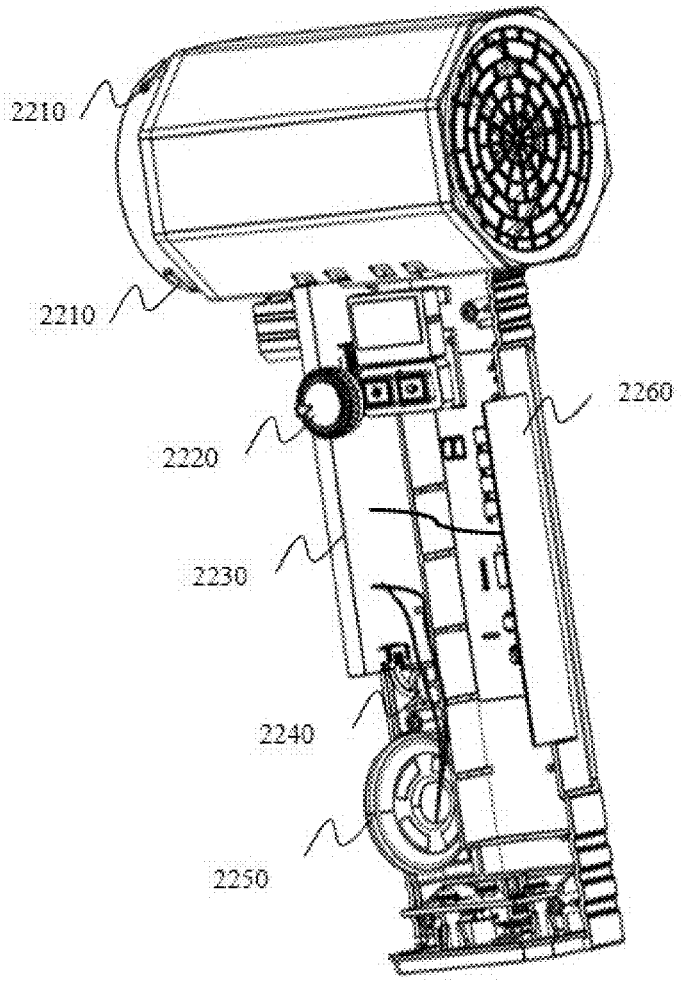
FIG. 22 is an exemplary structural diagram of an electrostatic prevention housing of an air blower according to some embodiments of the present disclosure.

In some embodiments, as shown in FIG. 22, an electrostatic prevention housing 2230 may be provided within an air blower. As shown in FIG. 22, circuit boards (e.g., a first circuit board, a second circuit board or a third circuit board) may be disposed inside the electrostatic prevention housing 2230, so as to prevent electrostatic flowing into the circuit boards.

In some embodiments, the electrostatic prevention housing 2230 may be enclosed on all sides, with only a few through holes to allow passage of data cables, electric wires, or conductive wires. In some embodiments, as shown in FIG. 22, a long wall of the electrostatic prevention housing 2230 may be between the circuit board and a slot 820, which is formed between the base housing 212-2 and the upper cover 212-1, thereby decreasing damage to the circuit boards caused by electrostatic discharge from a human body.

In some embodiments, the electrostatic prevention housing 2230 may be insulated. For the electrostatic prevention housing 2230 may be provided as an electrically insulating plate. In some embodiments, material for preparing the electrostatic prevention housing 2230 may include epoxy resin, polyvinyl chloride, rubber, ceramic, glass fiber, and/or carbon fiber, etc. For example, the electrostatic prevention housing 2230 may be an epoxy resin housing.

In some embodiments, the circuit boards of the air blower may be disposed inside the electrostatic prevention housing 2230, thereby expanding the shielding coverage against electrostatic charges in the air and effectively isolating electrostatic interference coming from various directions in space.

Figure 23:
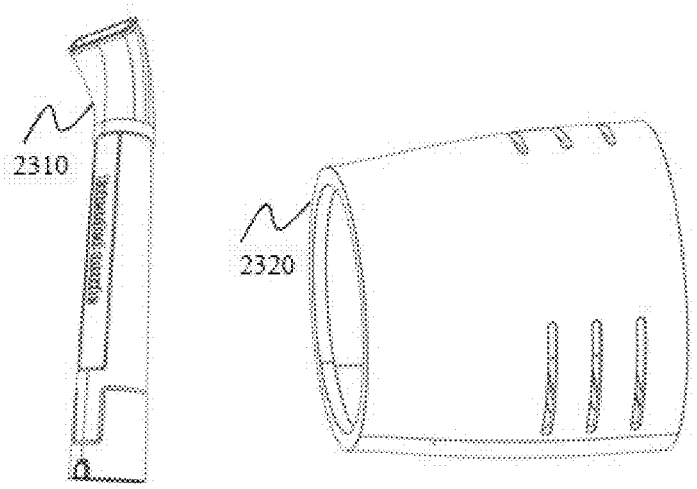
FIG. 23 is an exemplary structural diagram of an air nozzle(s) according to some embodiments of the present disclosure.

In some embodiments, as shown in FIG. 23, the air blower may further include an air nozzle(s), such as a pressure-boosting air nozzle 2320 or an extension nozzle 2310. For example, to enhance the pressure of the airflow at the air outlet end, a pressure-boosting air nozzle 2320 may be disposed at the air outlet end. As another example, to extend the reach of the airflow, an extension nozzle 2310 may be provided at the air outlet end. In some embodiments, disposing different air nozzles at the air outlet end of the air blower, such as the pressure-boosting air nozzle 2320 or the extension nozzle 2310 can allow a single air blower to meet diverse airflow demands, thereby improving its adaptability across various usage scenarios.

In some embodiments, as shown in FIG. 22, the air nozzles may be fixed to the air outlet end of the air blower via bayonet structures 2210 provided on the air blower.

When the air blower 110 is working, the high-speed rotation of the impeller 1310 usually generates and accumulates static charge inside the air blower 110. The static charge is transmitted through the motor 1210 and concentrated onto the first circuit board 420, which is electrically connected to the motor 1210. The accumulation of the static charge on the first circuit board 420 may cause electrostatic discharge, leading to damage to the internal circuit structure of the circuit board.

In some embodiments, the air blower 110 may further include a conductive structure(s) 410. In some embodiments, one end of the conductive structure 410 may be configured to be connected to the circuit board, and another end of the conductive structure 410 may be configured to be exposed outward from the grip area 260.

In some embodiments, the conductive structure 410 may be disposed on the base housing 212-2 and/or the upper cover 212-1 to enhance design redundancy, thereby improving the stability of electrostatic discharge.

In some embodiments, each of the conductive structure(s) 410 may include a conductive wire 411 (e.g., a copper wire) and/or a conductive body 240 (e.g., a screw nail).

In some embodiments, one end of the conductive body 240 may be configured to be embedded within the handle and connected to the conductive wire 411, and the other end may be exposed outside the housing 210. In some embodiments, the conductive wire 411 may be disposed within the handle.

In some embodiments, the conductive body 240 may be disposed on the grip area 260. That is, it can be ensured that during use, the conductive body 240 is always in contact with the user's hand, thereby enabling discharge.

In some embodiments, the conductive body 240 could be implemented as one or more contact points (e.g., a screw nail).

In some embodiments, one end of the conductive wire 411 may be configured to be connected to a negative electrode 421 of the circuit board, and the other end of the conductive wire 411 may be configured to be connected to the conductive body 240. In some embodiments, the negative electrode 421 is the only common electrode under the normal operating condition of all components on the circuit board, the optimal method is to connect the negative electrode 421 for discharge.

In some embodiments, the conductive wire 411 may be configured to be connected to the other electronic components of the circuit board.

In some embodiments, the air blower 110 may be provided with more than one of conductive structure(s) 410. In some embodiments, there two conductive structures with two conductive wires 411. One end of both wires is connected to the electrode 421 of the circuit board, while the other ends extend from the upper and lower sections of the battery 430 to the conductive bodies 240. The conductive bodies 240 of the two conductive structures 410 are respectively exposed outward through the base housing 212-2 and the upper cover 212-1. This design, by incorporating conductive structures on both the handle's base housing and upper cover, enhances redundancy and improves the stability of electrostatic discharge.

In some embodiments, the conductive body 240, which is exposed outward, may be disposed on the same side of the housing 210 as the air inlet end 250, ensuring the conductive body 240, which is exposed outward can always be in contact with the user.

In some embodiments, the air blower may include a conductive patch 2260. As shown in FIG. 22, the conductive patch 2260 may be disposed on the surface of a gripping area. In some embodiments, one end of a conductive wire 411 may be configured to be connected to a negative electrode 421 of the circuit board, and the other end of the conductive wire 411 may be configured to be connected to the conductive patch 2260. Because the conductive patch 2260 accounts for a relatively large portion of the gripping area, a larger contact area is formed between the user's palm and the conductive patch 2260 when the user grips the air blower, thereby enhancing the efficiency of electrostatic conduction.

In some embodiments of the present disclosure, during use, the user holds the grip area to perform the blowing operation. In this case, the user's hand comes into contact with the exposed part of the conductive structure(s). During the blowing operation, the static charge generated by the high-speed rotation of the impeller is transferred to the circuit board connected to the motor. This charge is then transferred in real time through the conductive structure(s) to the user's body, preventing excessive static charge buildup and electrostatic discharge.

In some embodiments, as shown in FIG. 1, the storage device 120 may be any component playing a storage function. The storage device 120 may be configured to store related information (e.g., systems, software, programs, images, sounds, characters, instructions, digits, etc.). In some embodiments, the storage device 120 may store information (e.g., a first preset value, a second preset value, or the like) inputted by the user terminal 150 and/or information (e.g., a continuous single operation duration) generated by the processor or the air blower. In some embodiments, the storage device 120 may be part of the processor, the air blower and/or the user terminal 150.

In some embodiments, the network 130 may be a single network 130 or a combination of networks 130. For example, the network 130 may include a local area network 130 (LAN), a wide area network 130 (WAN), a public network 130, a private network 130, a proprietary network 130, a wireless local network 130, a virtual network 130, a metropolitan area network 130, a public switched telephone network 130 (PSTN), or the like, or any combination thereof. The network 130 may include multiple network 130 access points, such as a wired access point, a wireless access point, a base station, or a network 130 switching point. In some embodiments, user may update a first preset value, a second preset value, a first preset direction, a second preset direction, a third preset direction, and/or a fourth preset direction via the network 130.

In some embodiments, the user terminal 150 may include a cell phone, a personal computer, a tablet, a headset, a watch (e.g., a smart watch), a bracelet (e.g., a smart bracelet), smart glasses, or the like. In some embodiments, the user may update the relevant parameters (e.g., the first preset value, and/or the second preset value) of the air blower through the user terminal 150. In some embodiments, the user terminal 150 may be configured to receive operating condition of the air blower sent by the air blower via the network, such as a remaining continuous single operation duration, a temperature, and/or a rotation speed, etc.

In some embodiments, a processor may control an operation of the server 140, the air blower, and/or user terminal 150 via computer program instructions. The computer program instructions may be stored in one or more storage. In some embodiments, the processor 210 may include a microcontroller, a reduced instruction-set computer (RISC), an application specific integrated circuit (ASIC), an application specific instruction-set processor (ASIP), a central processing unit (CPU), a graphic processing unit (GPU), a physical processing unit (PPU), a microprocessor unit, a digital signal processor (DSP), a field programmable gate array (FPGA), or other circuits or processors capable of executing computer program instructions, or any combination thereof.

In some embodiments, a indication method for the air blower is provided and it should be noted that the air blower illustrated in FIGS. 2-9 is merely exemplary rather than limited to the specific structure of the air blower to use the indication method.

In some embodiments, the air blower 110 may include at least two operation levels, one of which is a target operation level. In some embodiments, a single operating duration of the air blower 110 at the target operation level should be less than or equal to a first preset value. That is to say the air blower 110 should not operate at the target operation level for a long time.

In some embodiments, the target operation level may be any operation level of the air blower 110; this is not limited herein. For example, the target operation level could be the highest operation level, in which airflow generated by the air blower 110 achieves the maximized speed and/or temperature. In some embodiments, a user can set the target operation level. For example, the user may use a user terminal 150 to select any operation level from multiple operation levels corresponding to the air blower as the target operation level, thereby setting the target operation level.

In some embodiments, when the target operation level is the highest operation level of the air blower 110, the air blower 110 operates at maximized power, resulting in the highest heat generation from the battery 430.

In some embodiments, the maximum of single operating duration in the target operation level, i.e., the first preset value, can be set in advance, thereby preventing the battery 430 from overheating. In some embodiments, the user may set the first preset value according to actual needs, such as 10s, 20s, or 30s. For example, the user may use the user terminal 150 to transmit a customized first preset value to the air blower via a network 130, thereby setting the first preset value.

In some embodiments, the air blower 110 may include at least two operation levels, which include the target operation level and other operation levels. The number of the other operation levels is not limited in the embodiments of the present disclosure. For example, the other operation levels may include at least one of standby level, first operation level, second operation level, third operation level, and fourth operation level. The standby level refers to an optional setting where the air blower 110 is powered on but not in operation.

In some embodiments, limiting the continuous operating duration of the air blower within the target operation level can prevent battery overheating and excessive accumulation of static electricity inside the air blower, thereby avoiding damage caused by prolonged operation, while enabling users to customize the preset value can further enhance the safety and flexibility of the air blower.

The user should be indicated about operation time information at least not later than the single operation duration reaching the first preset before the air blower stops. The operation time information could be at least one from the remaining single operation duration, the moment when the target operation value is about to be reached, and the moment the target operation value is reached. This allows users to preview the device's remaining operational time when using the target level, enabling more efficient utilization of the target operation level and ultimately enhancing both operational efficiency and user experience.

There could be many ways to indicate the user about the operation time information.

In some embodiments, as shown in FIG. 22, the air blower may include a vibration device, such as a vibration motor 2240.

In some embodiments, as shown in FIG. 22, the air blower may include a speaker device, such as a speaker 2250.

Figure 24:
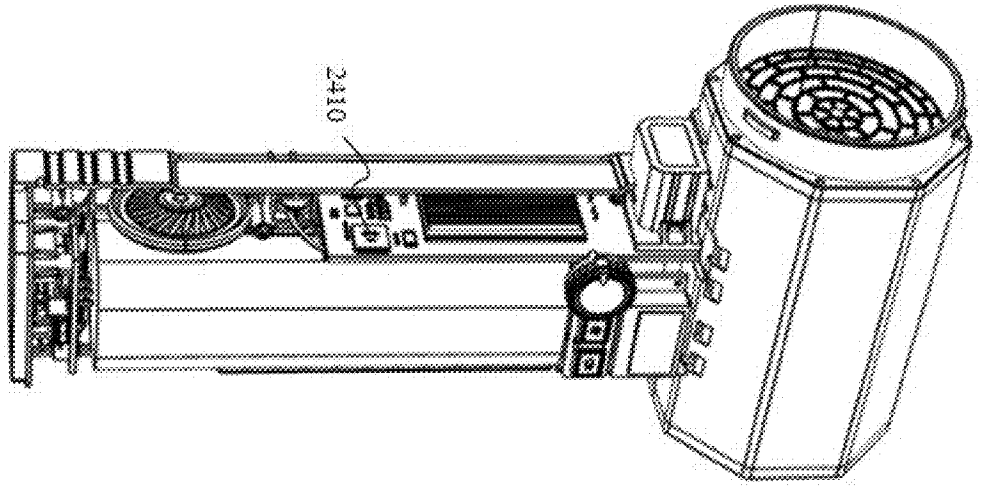
FIG. 24 is an exemplary structural diagram of a communication device of an air blower according to some embodiments of the present disclosure.

In some embodiments, as shown in FIG. 24, the air blower may include a communication device, such as a bluetooth communication chip 2410.

In some embodiments, the air blower may indicate operating time information of the air blower in a preset manner(s). In some embodiments, the operating time information may include a remaining single operation duration corresponding to the air blower operating in the target operation level in real time.

In some embodiments, the operating condition is also indicated to the user which may include temperature, power, and/or rotation speed of the air blower.

In some embodiments, the preset manner(s) may include: voice indication, vibration indication and/or visual indication, etc.

In some embodiments, the air blower may be configured to drive the speaker device to play audio related to the operating time information and/or the operation condition of the air blower. For example, the air blower may be configured to drive the speaker device to play audio related to the remaining single operation duration corresponding to the air blower 110 operating in a target operation level in real time. As another example, in the case that the temperature of the air blower 110 approaches a preset limit temperature, the air blower 110 may be configured to output a voice prompt through the speaker device, so as to provide real-time thermal status awareness to the user. As another example, in the case that the remaining single operation duration runs out, the air blower 110 may be configured to output a voice prompt through the speaker device.

In some embodiments, the air blower may be configured to drive the vibration device to vibrate according to a preset vibration rule. For example, as the remaining continuous single operation duration decreases, the air blower may be configured to vibrate at an increasing frequency. In some embodiments, the preset vibration rule may be set by the user.

In some embodiments, the air blower may be configured to provide a visual indication on the display screen of the air blower. More descriptions of the visual indication may refer to following description.

In some embodiments, during the operation of the air blower, presenting the single operation duration of the air blower to the user in real time through auditory, visual, and tactile means can help the user better understand the operation condition of the air blower in different scenarios (such as noisy environments or nighttime), thereby enhancing the user experience.

In some embodiments, the user terminal (e.g., a cell phone or a headset) communicatively connected to the air blower may perform the aforementioned indicator manner(s). For example, the user's cell phone may be configured to display the remaining single operation duration corresponding to the air blower 110 operating in a target operation level in real time. The user's headset or cell phone may be configured to play audio related the remaining single operation duration corresponding to the air blower 110 operating in a target operation level in real time. The user's headset or cell phone may be configured to vibrate according to a preset vibration rule. In some embodiments, the preset vibration rule may be set by a user.

In some embodiments, indicating the operating condition of the air blower via the user terminal can help the user accurately grasp the air blower's operating condition, thereby avoiding energy waste or air blower damage caused by overtime operation.

In some embodiments, the air blower may be configured to provide a visual indication that displays a duration indicator area 2010 on the air blower 110.

In some embodiments, the air blower may be configured to perform: displaying a duration indicator area 2010 on the air blower 110. The duration indicator area 2010 refers to indicate the remaining single operation duration corresponding to the air blower 110 operating at a target operation level in real time.

In some embodiments, as shown in FIG. 20, the air blower 110 displays the duration indicator area 2010, which displays the remaining single operation duration when operating in the target operation level, thereby improving the efficiency of the air blower 110 and enhancing the user experience.

In some embodiments, when the air blower 110 operates in the target operation level, the remaining single operation duration refers to the time the air blower 110 may continue to operate in the target operation level. The remaining single operation duration decreases as the operation time of the air blower 110 in the target operation level increases.

In some embodiments, when the air blower 110 doesn't operate at the target operation level, the remaining single operation duration refers to the remaining time the air blower 110 may operate at the target operation level in the next time.

In some embodiments, the duration indicator area 2010 may display the remaining single operation duration in digital form, such as 10%, 10 seconds, 2 minutes, or 0.5 hours. In some embodiments, the duration indicator area 2010 may display the remaining operation duration using alternative forms, such as an energy bar or a battery level bar.

In some embodiments of the present disclosure, displaying the remaining single operation duration in the target operation level on the air blower in real time, the device not only improves operational efficiency but also helps prevent battery overheating, thereby enhancing the user experience.

In some embodiments, the air blower 110 may be provided with a display screen 2040. In some embodiments, the duration indicator area 2010 may be disposed on the display screen 2040. For example, the duration indicator area 2010 may be displayed on the display screen 2040.

In some embodiments, as shown in FIG. 20, the duration indicator area 2010 may include a starting position 2011, an ending position 2012 and/or an indicator mark 2013. In some embodiments, the indicator mark 2013 may be configured to move between the starting position 2011 and the ending position 2012.

In some embodiments, a display assembly 2100 may be configured to display the battery level bar of the air blower 110, which may indicate the battery level of a battery 430 of the air blower 110 in real time.

In some embodiments, the air blower 110 may be configured to perform: in response to the target operation level being triggered, the indicator mark 2013 moving along a first preset direction.

In some embodiments, the first preset direction refers to a direction from the starting position 2011 to the ending position 2012. In some embodiments, the duration of the movement of the indicator mark 2013 from the starting position 2011 to the ending position 2012 may be equal to the first preset value.

In some embodiments, the indicator mark 2013 may be configured to move from a middle position. For example, the indicator mark 2013 may move from the middle position towards the ending position 2012. The middle position refers to any position between the starting position 2011 and the ending position 2012.

In some embodiments, the indicator mark 2013 may move from its position at the time the target operation level is triggered.

It may be appreciated that when the indicator mark 2013 moves to coincide with the ending position 2012, it indicates that the remaining duration of the air blower 110 in the target operation level has been exhausted. In this case, the air blower 110 may stop.

In some embodiments, the display assembly 2100 may be configured to display an operation voltage, an operation current, a rotation speed of the motor 1210, and/or information of the operation level, etc.

In some embodiments of the present disclosure, the movement of the indicator mark 2013 within the duration indicator area to visually represent the remaining continuous single operation duration in the target operation level in real time can enhance the user's awareness of the device status, thereby improving the overall user experience.

In some embodiments, the air blower 110 may be configured to perform: when the air blower 110 stops at the target operation level, the indicator mark 2013 moving along a second preset direction. The second preset direction refers to a direction from the ending position 2012 back to the starting position 2011. That is, after the air blower 110 stops operating, the indicator mark 2013 may move along an opposite direction corresponding to the first preset direction.

In some embodiments, when the indicator moves from the ending position 2012 back to the starting position 2011, the target operation level may be triggered again. In this case, the user may determine, based on whether the indicator has reached the starting position 2011, whether the target operation level should be triggered next time.

In some embodiments, when the indicator reaches to the starting position 2011, the target operation level may be triggered again. In some embodiments, when the target operation level is triggered again, the indicator may move from a position where the target operation level is triggered to the ending position 2012. In this case, the user may determine, based on the current position of the indicator mark 2013, the remaining single operation duration of the air blower 110 in the target operation level.

In some embodiments of the present disclosure, the back-and-forth movement of the indicator mark can allow the user to intuitively determine the status and remaining single operation duration of the target operation level, thereby enhancing the user experience and the controllability of the device.

In some embodiments, the duration indicator area 2010 may include a first indicator area and a second indicator area. The first indicator area refers to the area between a starting position 2011 and an indicator mark 2013. The second indicator area refers to the area between the indicator mark 2013 and the ending position 2012.

In some embodiments, the first indicator area may possess different features (e.g., a color, luminance, a shape, size, and/or texture, etc.) from the second indicator area. That is, the user may visually distinguish the first indicator area and the second indicator area.

In some embodiments, the movement of the indicator mark 2013 may be continuous. That is, to human eyes, the indicator mark 2013 may appear to move continuously rather than abruptly jumping from one position to another position.

In some embodiments, the movement of the indicator mark 2013 may be non-continuous. That is, to human eyes, the indicator mark 2013 may appear to jump from one position to another position.

In some embodiments of the present disclosure, by dividing the duration indicator area into different indicator regions (e.g., the first indicator area and the second indicator area) and assigning them distinct visual features, the user can clearly distinguish the starting position, the indicator mark, and the ending position. This allows the user to intuitively understand the operating status of the device.

In some embodiments, the air blower with an adjusting pressing button may be configured to perform steps 1610-1630, and the different pressing durations of the button relate to different operations.

In some embodiments, the adjusting pressing button(s) may include a first button 330, and/or a second button 340 as shown in FIG. 3.

At S1610, obtaining a trigger duration of an adjusting pressing button from the user.

In some embodiments, the air blower 110 may determine the trigger duration based on a change in electrical level of the adjusting pressing button. For example, the processor may calculate the trigger duration of the adjusting pressing button based on a pressing moment and a releasing moment. The pressing moment refers to the moment when the adjusting pressing button is pressed. The releasing moment refers to the moment when the adjusting pressing button is released.

In some embodiments, the processor of the air blower 110 may determine whether the adjusting pressing button is pressed or released based on a change of an electrical level in the adjusting pressing button.

In some embodiments, the air blower 110 may be configured to perform: determining whether the adjusting pressing button is pressed based on a pressure acting on the adjusting pressing button. For example, the processor may determine the button is pressed when the pressure acting on the button exceeds a preset pressure value. In some embodiments, the preset pressure value may be set in advance. In some embodiments, the air blower 110 may be provided with a pressure sensor disposed for the adjusting pressing button to detect the pressure acting on the button. For example, the pressure sensor may be disposed under the button.

At S1620, in response to the trigger duration being greater than or equal to a second preset value, triggering a target operation level.

In some embodiments, when the trigger duration of the adjusting pressing button by the user is greater than or equal to a second preset value, the target operation level may be triggered.

At S1630, in response to the trigger duration being less than the second preset value, switching between at least two operation levels.

In some embodiments, when the trigger duration of the adjustment button by the user is less than the second preset value, the air blower 110 may switch the operation levels, such as from the first operation level to the second operation level. In this case, the air blower 110 may adjust the output power to match the power output of the second operation level. In some embodiments, the second preset value may be set in advance, such as 1 s, 2 s, etc.

In some embodiments, short-time pressing the adjusting pressing button may cycle switch the operation levels in such order: the standby mode, the first operation level, the second operation level, the third operation level. In some embodiments, the target operation level may only be triggered by the adjusting pressing button being long-time pressed. Short-time pressing refers to the pressing duration of the adjusting pressing button less than the second preset value. Long-time pressing refers to the pressing duration of the adjusting pressing button being greater than or equal to the second preset value.

In some embodiments, the second adjustment button 340 may be also rotatable. In some embodiments, the air blower 110 may be switched to the corresponding operation level (e.g., the target operation level) based on the degree of rotation of the adjustment button.

In some embodiments, as shown in FIG. 22, the air blower may further include a third adjustment button 2220 which may be rotatable. For example, the air blower may be configured to switch the operation levels by the rotation of the third adjustment button 2220, thereby adjusting the speed of the airflow. The power of the air blower may increase as the third adjustment button 2220 is rotated clockwise. When the third adjustment button 2220 is rotated to the end of its clockwise range, the air blower may switch to a target operation level. When the third adjustment button 2220 is rotated to the end of its counterclockwise range, the air blower may switch to a standby mode.

In some embodiments of the present disclosure, excluding the target operation level from operation level switching can save power consumption and prevent accidental activation of the target operation level during switching. In some embodiments, setting the target operation level to be triggered only by a long press of the adjustment button can reduce the power consumption of the air blower 110.

In some embodiments of the present disclosure, the operation level of the air blower is controlled based on the pressing duration of the adjusting pressing button. When the pressing duration is greater than or equal to the second preset value, the target operation level is triggered. When the pressing duration is less than the second preset value, the device switches between the operation levels. This method can help save power, prevent accidental triggering of the target operation level, and optimize the user experience by triggering the target mode through a long press of the adjustment button.

In some embodiments, the duration indicator area 2010 of the air blower includes a plurality of light-emitting elements arranged sequentially, such as a plurality of light beads. In some embodiments, the plurality of light beads may form a light strip. That is, the light strip is an LED strip and the light beads are LED beads.

Figure 17:
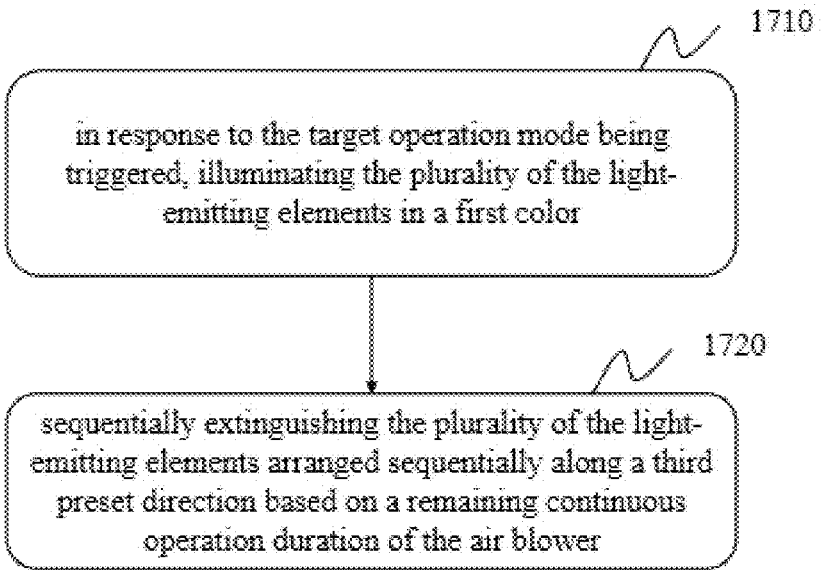
FIG. 17 is an exemplary flowchart of an indicating method according to some other embodiments of the present application.

In some embodiments, an indicating method includes as shown in FIG. 17: S1710, in response to the target operation level being triggered, controlling the light-emitting elements to sequentially turn off in the third direction, where the light-emitting elements retain a first color before turned off.

In some embodiments, the plurality of the light-emitting elements may be configured to indicate the operating duration by the bright/dark color. For example, the longer the air blower has been operating in the target operation level, the more the light-emitting elements would been extinguished. When all of the light-emitting elements are extinguished, it indicates that the remaining operating duration of the air blower 110 operating in the target operation level has been exhausted.

In some embodiments, the plurality of the light-emitting elements is not only used to indicate the remaining single operation duration, but also used to indicate operation level information and/or battery level information. The operation level information refers to information about the operation levels of the air blower 110. The battery level information refers to the battery level of the air blower 110. In some embodiments, the battery level information may include a present a remaining battery level.

In some embodiments, the plurality of the light-emitting elements may indicate different information by different colors. For example, the plurality of the light-emitting elements may indicate the remaining single operation duration of the air blower 110 by using a first color, which may be cyan. The plurality of the light-emitting elements may indicate the operation level information by using a second color which may be blue. The plurality of the light-emitting elements may indicate the battery level information by using a third color which may be green. In some embodiments, the first color, the second color, and the third color may be different from each other.

In some embodiments, the total extinguishing time for all of the light-emitting elements may be equal to a first preset value.

The sequentially extinguishing of the light-emitting elements can intuitively display the remaining single operation duration of the air blower. The light-emitting elements may also indicate the operation level and/or battery level of the air blower by different colors. The user can obtain the remaining single operation duration and battery status of the air blower in real-time from the state of the light-emitting elements, thereby improving the user experience.

In some embodiments, after the air blower 110 stops operating at a target operation level, the plurality of the light-emitting elements may be sequentially turned on along a fourth preset direction which may be opposite to the third preset direction. Here after the air blower 110 stops operating, the extinguished light-emitting elements may gradually be turned on.

In some embodiments, the target operation level may not be triggered again until all of the extinguished light-emitting elements have been turned on.

In some embodiments, the target operation level may be triggered again during the process of the plurality of extinguished light-emitting elements being turned on. In some embodiments, the operation duration of the air blower after being triggered again may be related to the number of the light-emitting elements in turning-on state at the moment of being triggered. The more light-emitting in turning-on state, the longer the operation duration of the air blower 110 operating in the target operation level after being triggered again.

Optionally, when all of the light-emitting elements are turned on in the first color, the total time for all the light-emitting elements from the turning-on state to turning-off state is equal to the first preset value.

Optionally, the total time for all the light-emitting elements from turning-off state to turning-on state is equal to the first preset value.

Figure 18:
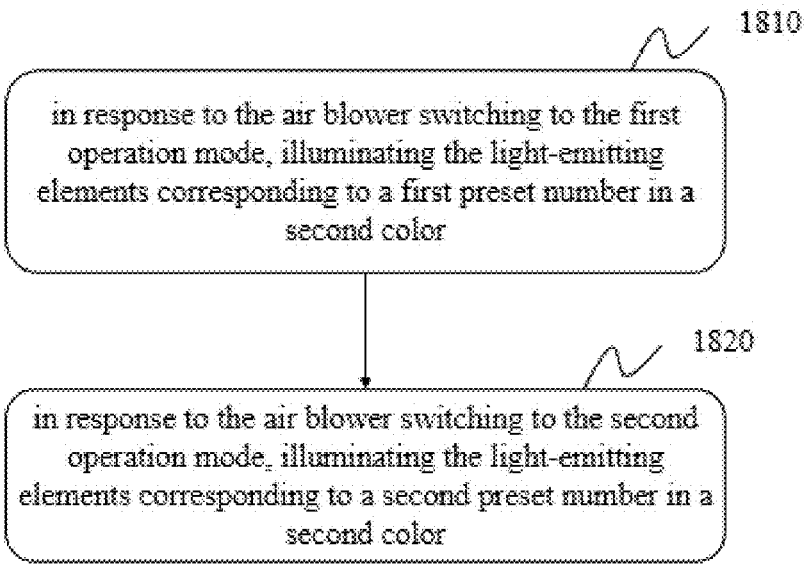
FIG. 18 is an exemplary flowchart of an indicating method according to some other embodiments of the present application.

In some embodiments, the at least two operation levels may include a first operation level and a second operation level. In some embodiments, as shown in FIG. 18, the air blower may be configured to perform steps 1810-1820.

S1810: in response to the air blower switching to the first operation level, turning on a first preset number of the light-emitting elements in a second color.

S1820: in response to the air blower switching to the second operation level, turning on a second preset number of the light-emitting elements in a second color.

The first color may differ from the second color and the first preset number may differ from the second preset number.

In some embodiments, the plurality of the light-emitting elements may be configured to indicate operation level information. In some embodiments, the color of the light-emitting elements used to indicate the operation level information may differ from the color of the light-emitting elements used to indicate the remaining single operation duration. For example, the plurality of the light-emitting elements may be implemented as a multi-function indicator. In some embodiments, different numbers of the light-emitting elements may be turned on to distinguish different operation levels.

As an example, the air blower 110 is provided with six light-emitting elements, such as six light beads. The air blower 110 is provided with three operation levels, such as a first operation level, a second operation level, and a third operation level. When the air blower 110 is switched to the first operation level, the air blower 110 turns on two light beads. When the air blower 110 is switched to the second operation level, the air blower 110 turns on four light beads. When the air blower 110 is switched to the third operation level, the air blower 110 turns on six light beads. In some embodiments, the number of the light-emitting elements turned on each of the operation levels may be preset. In some embodiments, the number of the operation levels may be preset.

In some embodiments of the present disclosure, the different operation levels of the air blower are indicated by varying the colors and the number of light-emitting elements. The user can intuitively understand the current operational status and mode of the air blower through the changes in the lighting.

In some embodiments, the at least two operation levels may include a standby mode. And the indicating method includes: in response to the air blower 110 switching to the standby mode, the air blower 110 turns on at least one light-emitting element of the plurality of the light-emitting elements in a third color, so that the at least one light-emitting elements turned on in a third color could indicate the present battery level of the air blower. In some embodiments, the color for indicating the battery level is different from the colors for indicating operation level and the remaining operation duration.

By turning on light-emitting elements in different colors in the standby mode, the current battery level of the air blower can be clearly indicated. By different colors of the light-emitting elements the user may quickly distinguish the battery level information from other mode indicators, thereby improving user experience and the ease of use of the device.

In some embodiments, as shown in FIG. 21, the displaying component 2100 applicated in air blower may include a display module 2110 and a controlling module 2120; wherein the air blower may be configured with at least two operation levels, one of which is a target operation level. A single operating duration of the air blower 110 at the target operation level should be less than or equal to a first preset value. That is to say the air blower 110 should not operate at the target operation level for a long time. The target operation level may be the highest operation level, or any other operation level, which is not limited here.

In some embodiments, the display module 2110 may be configured to display a duration indicator area 2010 on the air blower 110. The duration indicator area 2010 is used to indicate a remaining single operation duration of the air blower 110 operating at the target operation level in real time. In some embodiments, by the duration indicator area 2010, user may be easy to know the remaining single operation duration when operating the air blower at the target operation level, thereby improving the efficiency of the air blower 110 and enhancing the user's experience.

To clarify, when the air blower is operating at the target operation level, the remaining single operation duration refers to the remaining time the air blower 110 may continue to operate at the target operation level which would decreases as the operation time of the air blower 110 at the target operation level increases. When the air blower 110 doesn't operate at the target operation level, the remaining single operation duration refers to the remaining time the air blower 110 may continue to operate at the target operation level for the next time.

In some embodiments, the duration indicator area 2010 may display the remaining single operation duration in digital form, such as 10%, 10 seconds, 2 minutes, or 0.5 hours. In some embodiments, the duration indicator area 2010 may display the remaining single operation duration using alternative forms, such as an energy bar or a battery level bar.

In some embodiments, as shown in FIG. 3, the air blower 110 may be provided with a display screen 2040.

In some embodiments, the air blower 110 may be provided with a display screen 2040. In some embodiments, the duration indicator area 2010 may be disposed on the display screen 2040. For example, the duration indicator area 2010 may be displayed on the display screen 2040.

In some embodiments, the duration indicator area 2010 may include a starting position 2011, an ending position 2012 and/or an indicator mark 2013. In some embodiments, the indicator mark 2013 may be configured to move between the starting position 2011 and the ending position 2012.

In some embodiments, a display assembly 2100 may be configured to display the battery level bar of the air blower 110, which may indicate the battery level of a battery 430 of the air blower 110 in real time.

In some embodiments, the air blower 110 may be configured to perform: in response to the target operation level being triggered, the indicator mark 2013 moving along a first preset direction.

In some embodiments, the controlling module 2120 may be configured to control the execution of the following actions: in response to the target operation level being triggered, the indicator mark 2013 moves along a first preset direction. In some embodiments, the first preset direction refers to a direction from the starting position 2011 to the ending position 2012. In some embodiments, the duration of the movement of the indicator mark 2013 from the starting position 2011 to the ending position 2012 may be equal to the first preset value.

In some embodiments, the indicator mark 2013 may be configured to move from a middle position. For example, the indicator mark 2013 may move from the middle position towards the ending position 2012. The middle position refers to any position between the starting position 2011 and the ending position 2012.

In some embodiments, the indicator mark 2013 may move from its position at the time the target operation level was triggered.

It may be appreciated that when the indicator mark 2013 moves to coincide with the ending position 2012, it indicates that the remaining duration of the air blower 110 in the target operation level has been exhausted. In this case, the air blower 110 may stop operating.

In some embodiments, the controlling module 2120 may be configured to further control the execution of the following actions: after the air blower 110 stops operating in the target operation level, the indicator mark 2013 moves along a second preset direction. The second preset direction refers to a direction from the ending position 2012 back to the starting position 2011. That is, after the air blower 110 stops operating, the indicator mark 2013 may move along an opposite direction corresponding to the first preset direction.

In some embodiments, when the indicator moves from the ending position 2012 to the starting position 2011, the target operation level may be triggered again. In this case, the user may determine, based on whether the indicator has reached the starting position 2011, whether the target operation level should be triggered next time.

In some embodiments, when the indicator reaches to the starting position 2011, the target operation level may be triggered again. In some embodiments, when the target operation level is triggered again, the indicator may move from a position where the target operation level is triggered to the ending position 2012. In this case, the user may determine, based on the current position of the indicator mark 2013, the remaining single operation duration of the air blower 110 in the target operation level.

In some embodiments, the duration indicator area 2010 may include a first indicator area and a second indicator area. The first indicator area refers to the area between a starting position 2011 and an indicator mark 2013. The second indicator area refers to the area between the indicator mark 2013 and the ending position 2012.

In some embodiments, the first indicator may possess different features (e.g., a color, luminance, a shape, size, and/or texture, etc.) than the second indicator area. That is, the user may visually distinguish the first indicator area and the second indicator area.

In some embodiments, the air blower is provided with a second button 340, which can be pressed to trigger different operation levels based on the duration of the press.

In some embodiments, the controlling module 2120 may be configured to control the execution of the following actions: obtaining a trigger duration for an adjustment button; in response to the trigger duration being greater than or equal to a second preset value, triggering a target operation level; in response to the trigger duration being less than the second preset value, switching between at least two operation levels.

Figure 19:
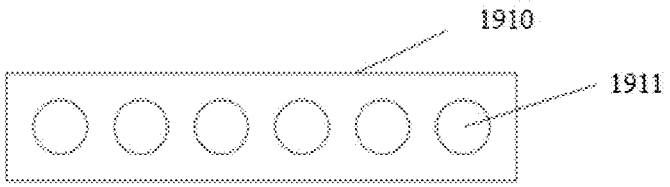
FIG. 19 is an exemplary schematic diagram illustrating light-emitting elements according to some embodiments of the present disclosure.

In some embodiments, the air blower 110 may include a duration indicator area 2010, which includes a plurality of light-emitting elements arranged sequentially, such as a plurality of light beads 1911 as shown in FIG. 19. In some embodiments, the plurality of light beads may form an LED light strip 1910. That is, the light beads may be provided as LED light beads 1911.

In some embodiments, the adjusting pressing button(s) may include a first button 330, and/or a second button 340 as shown in FIG. 3.

In some embodiments, the controlling module 2120 may be configured to control the execution of the following actions: obtaining a trigger duration of an adjusting pressing button from the user; in response to the trigger duration being greater than or equal to a second preset value, triggering a target operation level; and in response to the trigger duration being less than the second preset value, switching between at least two operation levels.

In some embodiments, the duration indicator area 2010 of the air blower includes a plurality of light-emitting elements arranged sequentially, such as a plurality of light beads. In some embodiments, the plurality of light beads may form a light strip. That is, the light strip is an LED strip and the light beads are LED beads.

In some embodiments, the controlling module 2120 may be configured to control the execution of the following actions: in response to the target operation level being triggered, controlling the light-emitting elements to sequentially turn off in the third direction, where the light-emitting elements retain a first color before turned off.

In some embodiments, the total time for all of the light-emitting elements from a turning-on state to a turning-off state may be equal to a first preset value.

In some embodiments, the plurality of the light-emitting elements may indicate different information by different colors. For example, the plurality of the light-emitting elements may indicate the remaining single operation duration of the air blower 110 by using a first color, which may be cyan. The plurality of the light-emitting elements may indicate the operation level information by using a second color which may be blue. The plurality of the light-emitting elements may indicate the battery level information by using a third color which may be green. In some embodiments, the first color, the second color, and the third color may be different from each other.

In some embodiments, after the air blower 110 stops operating at a target operation level, the plurality of the light-emitting elements may be sequentially turned on along a fourth preset direction which may be opposite to the third preset direction.

In some embodiments, the at least two operation levels may include a first operation level and a second operation level. In some embodiments, the controlling module 2120 may be configured to control the execution of the following actions: in response to the air blower 110 switching to the first operation level, turning on a first preset number of the light-emitting elements in a second color; in response to the air blower 110 switching to the second operation level, turning on a second preset number of the light-emitting elements in a second color. In some embodiments, the first color may differ from the second color and the first preset number may differ from the second preset number.

In some embodiments, the plurality of the light-emitting elements may be configured to indicate operation level information. In some embodiments, the color of the light-emitting elements used to indicate the operation level information may differ from the color of the light-emitting elements used to indicate the remaining single operation duration. For example, the plurality of the light-emitting elements may be implemented as a multi-function indicator. In some embodiments, different numbers of the light-emitting elements may be turned on to distinguish different operation levels.

As an example, the air blower 110 is provided with six light-emitting elements, such as six light beads. The air blower 110 is provided with three operation levels, such as a first operation level, a second operation level, and a third operation level. When the air blower 110 is switched to the first operation level, the air blower 110 turned on two light beads. When the air blower 110 is switched to the second operation level, the air blower 110 turned on four light beads. When the air blower 110 is switched to the third operation level, the air blower 110 turned on six light beads. In some embodiments, the number of the light-emitting elements lit in each of the operation levels may be preset. In some embodiments, the number of the operation levels may be preset.

In some embodiments, the at least two operation levels may also include a standby mode. In some embodiments, the controlling module 2120 may be configured to control the execution of the following actions: in response to the air blower 110 switching to the standby mode, the air blower 110 turning on at least one light-emitting element of the plurality of the light-emitting elements in a third color. The at least one light-emitting element may be configured to indicate a present battery level of the air blower 110. In some embodiments, the color of the light-emitting elements used to indicate the present battery level may differ from the color of the light-emitting elements used to indicate the operation level information and the color of the light-emitting elements used to indicate the remaining single operation duration.

The basic concepts have been described above, apparently, in detail, as will be described above, and does not constitute limitations of the disclosure. Although there is no clear explanation here, those skilled in the art may make various modifications, improvements, and modifications of present disclosure. This type of modification, improvement, and corrections are recommended in present disclosure, so the modification, improvement, and the amendment remain in the spirit and scope of the exemplary embodiment of the present disclosure.

At the same time, present disclosure uses specific words to describe the embodiments of the present disclosure. As "one embodiment", "an embodiment", and/or "some embodiments" means a certain feature, structure, or characteristic of at least one embodiment of the present disclosure. Therefore, it is emphasized and should be appreciated that two or more references to "an embodiment" or "one embodiment" or "an alternative embodiment" in various parts of present disclosure are not necessarily all referring to the same embodiment. Further, certain features, structures, or features of one or more embodiments of the present disclosure may be combined.

In addition, unless clearly stated in the claims, the order of processing elements and sequences, the use of numbers and letters, or the use of other names in the present disclosure are not used to limit the order of the procedures and methods of the present disclosure. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server 140 or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. However, this disclosure does not mean that the present disclosure object requires more features than the features mentioned in the claims. Rather, claimed subject matter may lie in less than all features of a single foregoing disclosed embodiment.

In some embodiments, the numbers expressing quantities of ingredients, properties, and so forth, used to describe and claim certain embodiments of the application are to be understood as being modified in some instances by the term "about," "approximate," or "substantially". Unless otherwise stated, "about," "approximate," or "substantially" may indicate ±20% variation of the value it describes. Accordingly, in some embodiments, the numerical parameters used in the specification and claims are approximate values, and the approximation may change according to the characteristics required by the individual embodiments. In some embodiments, the numerical parameter should consider the prescribed effective digits and adopt a general digit retention method. Although in some embodiments, the numerical fields and parameters used to confirm the breadth of its range are approximate values, in specific embodiments, such numerical values are set as accurately as possible within the feasible range.

With respect to each patent, patent application, patent application disclosure, and other material cited in the present disclosure, such as articles, books, manuals, publications, documents, etc., the entire contents thereof are hereby incorporated by reference into the present disclosure. Application history documents that are inconsistent with the contents of the present disclosure or that create conflicts are excluded, as are documents (currently or hereafter appended to the present disclosure) that limit the broadest scope of the claims of the present disclosure. It should be noted that in the event of any inconsistency or conflict between the descriptions, definitions, and/or use of terms in the materials appended to the present disclosure and those described in the present disclosure, the descriptions, definitions, and/or use of terms in the present disclosure shall prevail.

At last, it should be understood that the embodiments described in the present disclosure are merely illustrative of the principles of the embodiments of the present disclosure. Other modifications that may be employed may be within the scope of the present disclosure. Thus, by way of example, but not of limitation, alternative configurations of the embodiments of the present disclosure may be utilized in accordance with the teachings herein. Accordingly, embodiments of the present disclosure are not limited to that precisely as shown and described.

What is claimed is:

1. An air blower, comprising:

a housing provided with a grip area;

a motor disposed within the housing;

an impeller disposed within the housing;

a circuit board disposed within the housing; the circuit board is configured to be connected to the motor;

a conductive structure, one end of the conductive structure is configured to be connected to the circuit board, and another end of the conductive structure is configured to be exposed outward from the grip area; wherein the conductive structure comprises a conductive wire and a conductive body;

the conductive wire is configured to be respectively connected to the circuit board and the conductive body;

the conductive body is configured to be exposed outside the housing corresponding to the grip area;

the housing is provided with an upper housing and a handle;

the handle comprises an upper cover and a base housing; the air blower comprises two conductive structures; wherein both the conductive bodies of the two conductive structures are configured to respectively extend through the base housing and the upper cover, so as to be exposed outward;

the air blower comprises a blower cylinder, the blower cylinder is embedded within the upper housing;

the blower cylinder is provided with an air outlet end and an air inlet end;

the air outlet end and the air inlet end are respectively disposed on two sides of the housing;

the conductive body exposed outside the housing is disposed on the grip area;

the air blower further comprises a battery;

the battery is disposed within the handle;

the battery is disposed longitudinally along a length direction of the handle, perpendicular to the upper housing;

the air blower has at least two operation levels including a target operation level; a single operation duration of the air blower in the target operation level is less than or equal to a first preset value; and the air blower further comprises:

an adjustment button including a first button; and a controlling module configured to obtain a trigger duration for the adjustment button; in response to the trigger duration being more than or equal to a second preset value, triggering the target operation level; and in response to the trigger duration being less than the second preset value, switching between the at least two operation levels.

2. The air blower according to claim 1, wherein the conductive structure is configured to be connected to a negative electrode of the circuit board.

3. The air blower according to claim 1, further comprising:

the adjustment button including at least the first button and a second button disposed on the handle; and a lighting component disposed on a same side of the housing with the air outlet end;

wherein the first button is configured to turn on/off the lighting component, and/or adjust a light intensity, the lighting component faces an air blowing object together with the air outlet end, so as to illuminate the air blowing object and/or a target area in a dark environment; and wherein the second button controls the battery to discharge at percentages of its maximum power, thereby adjusting a rotational speed of the motor, so as to be configured turn on/off an airflow, and/or adjust an air volume of the airflow.

4. The air blower according to claim 3, further comprising an air nozzle fixed to the air outlet end of the air blower via at least two bayonet structures provided on the air blower, so as to enhance a pressure of the airflow at the air outlet end or to extend a reach of the airflow.

5. The air blower of claim 4, further comprising multiple lighting components at different positions of the air blower to increase an illumination area and reduce shadow interference from a user gripping the air blower.

6. The air blower according to claim 1, further comprising a display assembly configured to display a remaining battery level, an airflow speed, an airflow temperature, the at least two operation levels, and/or a continuous single operation duration;

wherein the air blower is configured to indicate an operating time information of the air blower in a voice indication, a vibration indication and/or a visual indication; the operating time information includes a remaining single operation duration corresponding to the air blower operating in the target operation level in real time.

7. The air blower according to claim 1, wherein the blower cylinder comprises a first sub-cylinder, a second sub-cylinder, and a third sub-cylinder, which are sequentially arranged from the air outlet end toward the air inlet end;

the air blower comprises further an air inlet grid;

an inner diameter of the blower cylinder outside the air inlet grid decreases from outside to inside;

the air blower comprises an arcuate slope surface, which is disposed on an outer side of the air inlet grid.

8. An air blower, comprising:

a housing provided with a grip area;

a motor disposed within the housing;

an impeller disposed within the housing;

a circuit board disposed within the housing; the circuit board is configured to be connected to the motor; and a conductive structure, one end of the conductive structure is configured to be connected to the circuit board, and another end of the conductive structure is configured to be exposed outward from the grip area;

the conductive structure comprises a conductive wire and a conductive body;

the conductive wire is configured to be respectively connected to the circuit board and the conductive body;

the conductive body is configured to be exposed outside the housing corresponding to the grip area;

the housing is provided with an upper housing and a handle;

the handle comprises an upper cover and a base housing; the air blower comprises two conductive structures; wherein both the conductive bodies of the two conductive structures are configured to respectively extend through the base housing and the upper cover, so as to be exposed outward;

the air blower further comprises a blower cylinder, the blower cylinder is embedded within the upper housing;

the blower cylinder is provided with an air outlet end and an air inlet end;

the air outlet end and the air inlet end are respectively disposed on the two sides of the housing;

the conductive body exposed outside the housing is disposed on the a same side of the housing with the air outlet end;

the air blower comprises a battery;

the battery is disposed within the handle;

the battery is disposed longitudinally along a length direction of the handle, perpendicular to the upper housing;

the air blower further comprises:

an adjustment button including at least a first button and a second button disposed on the handle; and a lighting component disposed on a same side of the housing with the air outlet end;

wherein the first button is configured to turn on/off the lighting component, and/or adjust a light intensity, the lighting component faces an air blowing object together with the air outlet end, so as to illuminate the air blowing object and/or a target area in a dark environment; and wherein the second button controls the battery to discharge at percentages of its maximum power, thereby adjusting a rotational speed of the motor, so as to be configured turn on/off an airflow, and/or adjust an air volume of the airflow; and the circuit board comprises a first circuit board, a second circuit board, and a third circuit board;

the first circuit board is disposed within one side of the handle, which is close to the battery, and the first circuit board is electrically respectively connected to the motor and the battery;

the second circuit board is disposed at a bottom of the battery, and the second circuit board is provided with a charge circuit, which is configured to charge the battery;

the third circuit board is disposed on a top of the battery, and the third circuit board is respectively electrically connected to the first button, and/or the second button.

* * * * *